US008647040B2

(12) United States Patent
Nice et al.

(10) Patent No.: US 8,647,040 B2
(45) Date of Patent: Feb. 11, 2014

(54) TRAY FLIP UNLOADER

(75) Inventors: Jeffrey R. Nice, Lutherville-Timonium, MD (US); Thomas Bland, Jr., Lutherville-Timonium, MD (US); Thomas I. Stewart, Jr., Lutherville-Timonium, MD (US); Corey A. Ness, Spring Grove, PA (US); Andrew S. Bramall, Railroad, PA (US)

(73) Assignee: RG Research, Inc., Lutherville-Timonium, MD (US)

( * ) Notice: Subject to any disclaimer, the term of this patent is extended or adjusted under 35 U.S.C. 154(b) by 1068 days.

(21) Appl. No.: 12/585,451

(22) Filed: Sep. 15, 2009
(Under 37 CFR 1.47)

(65) Prior Publication Data

US 2010/0290867 A1 Nov. 18, 2010

Related U.S. Application Data

(60) Provisional application No. 61/216,325, filed on May 14, 2009.

(51) Int. Cl.
*B65B 21/02* (2006.01)

(52) U.S. Cl.
USPC ..... 414/405; 414/810

(58) Field of Classification Search
USPC ..... 414/405, 810
See application file for complete search history.

(56) References Cited

U.S. PATENT DOCUMENTS 6,238,164 B1 * 5/2001 Isaacs ..... 414/405
7,856,797 B2 * 12/2010 Black et al. ..... 53/447

* cited by examiner

*Primary Examiner* — Saul Rodriguez
*Assistant Examiner* — Willie Berry, Jr.
(74) *Attorney, Agent, or Firm* — Nath, Goldberg & Meyer; Jerald L. Meyer; Stanley N. Protigal

(57) ABSTRACT

A mailpiece transfer system uses a transfer box to unload a plurality of mailpieces from an open tray, while maintaining an orientation alignment of the flat items. The tray is placed in the transfer box, after which the transfer box, holding the tray, is rotated to cause the mailpieces to rest against a cover of the transfer box. The tray is then removed, and the transfer box rotated again, allowing the substantially flat items to rest against a bottom of the transfer box, but without the tray. The mailpieces are then guided to a next workstation. The mailpieces may be edged for delivery to the next workstation.

21 Claims, 41 Drawing Sheets

TRAY FLIP UNLOADER

RELATED APPLICATION

The present Patent Application claims priority to Provisional Patent Application No. 61/216,325 filed May 14, 2009, which is assigned to the assignee hereof and filed by the inventors hereof and which is incorporated by reference herein.

BACKGROUND

1. Field

This disclosure relates to sheet handling, useful, for example, in the postal sorting industry. The disclosure further relates to receiving and feeding a sheet or object handler with sheets or objects supplied in batch quantities.

2. Background

In the postal sorting industry, postal mailpieces or letters are supplied from a first machine which performs a first procedure in trays. The letters in the trays are then loaded to a second machine, which performs a subsequent procedure. In a typical example, the first machine is a barcode encoder which reads the address from the mailpieces and applies a corresponding barcode to the mailpiece. The second machine receives the barcoded letters and sorts them for shipment.

The barcoding operation requires that an alignment of the letter be selected so as to allow the barcode encoder to read each address. The barcode encoder will typically align the barcode to coincide with the orientation and facing side of the mailpiece. As a result of reading the address and impressing the barcode, the barcode reader knows the directional alignment of the mailpiece. In order to avoid duplicating this alignment operation, the barcode encoder provides its output with the mailpieces in a uniform facing alignment.

The letters themselves, however, are not uniform. Those letters which pass the barcode encoder meet requirements regarding standard size limits for letters but those sizes of course vary widely within the requirements. Thus, as objects, the mailpieces are not uniform, which limits options for handling the mailpieces.

In one example, it is desired that the sorter receiving the barcoded mailpieces receive the mailpieces in a predetermined alignment. Since this alignment was already established by the barcode encoder, the mail exits the barcode encoder with such alignment. Therefore, if the alignment of the mail as it exits the barcode encoder is maintained, the mail can be fed to the sorter with that alignment.

In a typical operation, the processed mail is deposited into mail trays. The trays are open boxes, meaning containers having a bottom and four sides, but no top. In one common configuration, the trays have slanted sides. The processed mailpieces are placed in the trays so as to rest edgewise, with all mailpieces facing in the same direction.

In one particular type of operation, the processed mail from the barcode encoder is deposited into mail trays. The trays are open boxes, meaning containers having a bottom and four sides, but no top. In one common configuration, the trays have slanted sides. The majority of mailpieces processed by the bar code encoder are placed in the trays so as to rest edgewise with the barcodes in uniform alignment. This not only prepositions the barcode or address in proper directional and face-side position, but also positions the barcode at a desired x-y position for efficient reading by the barcode reader. In a typical example, each barcode is about 3.3 cm from the right side and about 0.6 cm from the bottom of the face of the mailpiece; however, it is anticipated that other standards may be used.

The present disclosure describes removing the mailpieces from the trays and loading the mailpieces to a piece of equipment such as the sorter, while edging the mailpieces and maintaining the alignment of the mailpieces with respect to their facing sides.

It is therefore desirable to automate the unloading of the trays, and automatically present and feed the faced and edged mail to a feeder/singulator for processing. The successful implementation of this technology results in the capability of a single mail processor to monitor the input operations of multiple feeder/singulators. In addition, the successful implementation of this technology offers significant cost savings, from reduced labor costs, as well as increased production efficiency.

SUMMARY

Transfer of a plurality of items, such as mailpieces, to a transport guideway is achieved while maintaining facing and edging of the plurality of items. The items are provided in a tray, in which each item has a matching directional alignment and rotational alignment. The tray holding the items is received with an open top in a transfer box and the plurality of items are exposed at the open top within the tray. The transfer box is closed to cover the open top of the tray, and rotated to position the open top of the tray in a generally downward facing orientation. The transfer box is opened to expose the tray, with the open top of the tray facing in the generally downward facing orientation. The tray is then removed from the transfer box. The transfer box retains the items for subsequent discharge. Discharged items are conveyed to the feeder/singulator of another piece of equipment such as a sorter. This conveyance uses a plurality of combs to control and deliver the discharged items. The combs provide unit manipulation of items discharged from a single tray.

DETAILED DESCRIPTION

Overview

The device automatically performs the following functions:

- Confirm proper tray orientation, and reorient or reject improperly orientated trays.
- Load the unsleeved tray into the flip unloader.
- Remove the mail from the tray.
- Automatically edge mail to be presented to the feeder/singulator.
- Maintain control of the mail slug.
- Transfer the mail slug to the input of the feeder/singulator.
- Establish and maintain the integrity of the mail slug facing and edging during and after transfer.

The trays are provided at an elevation above the feeder/singulator. A decline slide is used to bring the mail down to the feeder/singulator, and the slide is easily moved to allow operator access to the feeder/singulator when manual processing is required.

Physical Description

It is desired that the manual feed operations of the feeder/singulator remain accessible. This requires that a flip unloader be easily moved to allow access to the feeder/singulator for manual operations. Placing the flip unloader above the feeder/singulator satisfies this requirement. The trays are transported to the flip unloader by an overhead conveyor, and then the mail slugs are transferred to the feeder/singulator's operational level.

Figure 1:
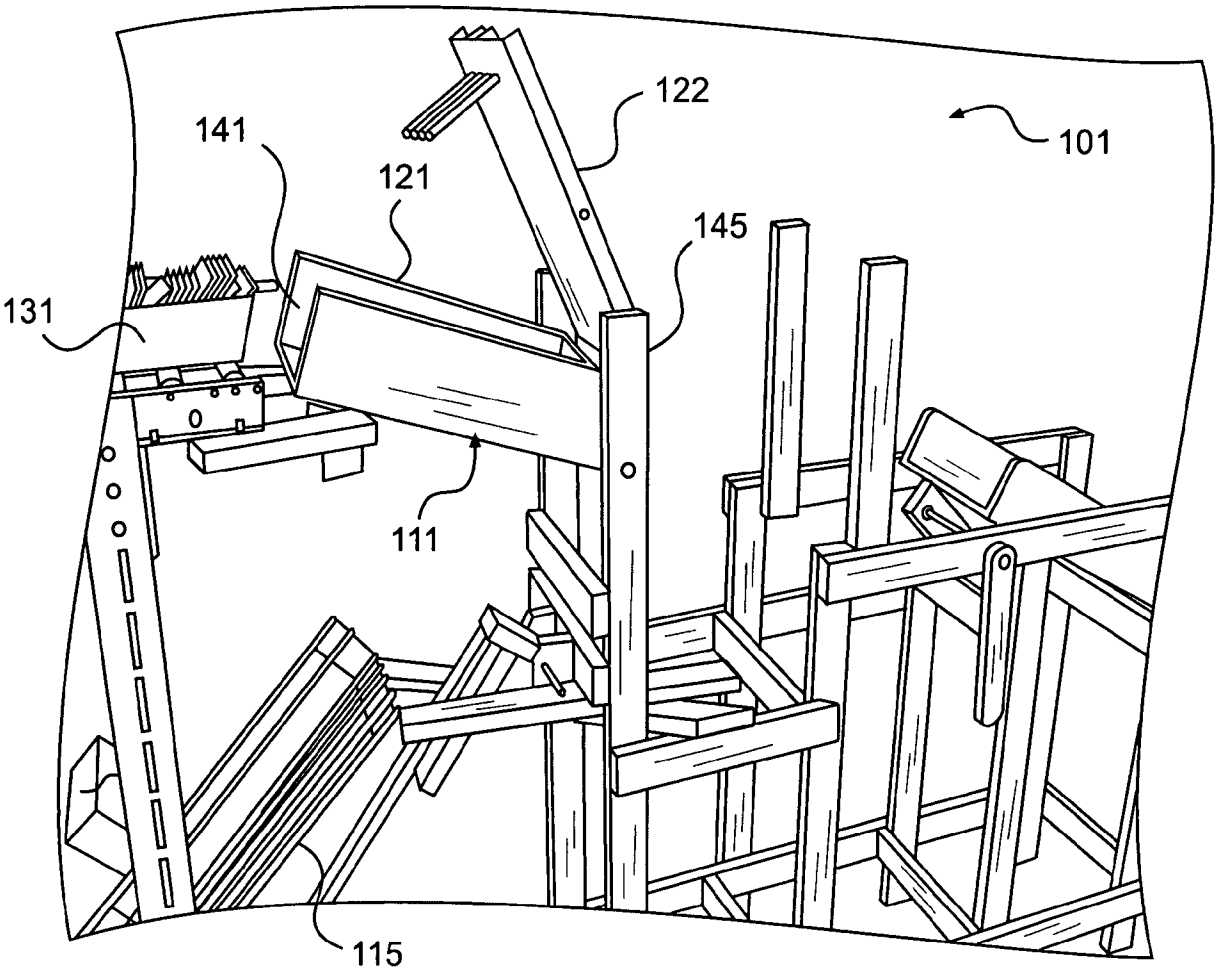
FIG. 1 is a diagram showing, a flip unloader open on one end to allow the entrance of the trays.

FIG. 1 is a diagram showing a mail transfer apparatus 101. Mail transfer apparatus 101 includes a flip unloader 111 mounted above a decline slide 115 to transfer the mail in slugs to an in-feed table at a feeder/singulator such as a delivery barcode sorter (not shown). A transition slide (316, shown in FIG. 3) at the bottom of decline slide 115 returns the mail to the horizontal plane for transfer to the feeder/singulator feed table. In addition, because proper edging of the mail is desired for proper feeding of the feeder/singulator, the apparatus 101 is configured to assure that the mail is edged. The apparatus 101 therefore comprises flip unloader 111, straight decline slide 115 and transition slide 316.

As depicted in FIG. 1, flip unloader 111 is a receiver including a box 121 and lid 122, and is of a size and shape to contain a tray 131. Flip unloader 111 is open on one end 141 to allow the entrance of the trays. The top of box 121 is covered by lid 122 attached to the box through a hinge 145. The box is connected to the frame through a pivot shaft on the same end of the box as hinge 145. While slant edge trays are depicted, it is also possible to use other tray configurations, such as trays having squared edges and trays with hand holes.

Figure 2:
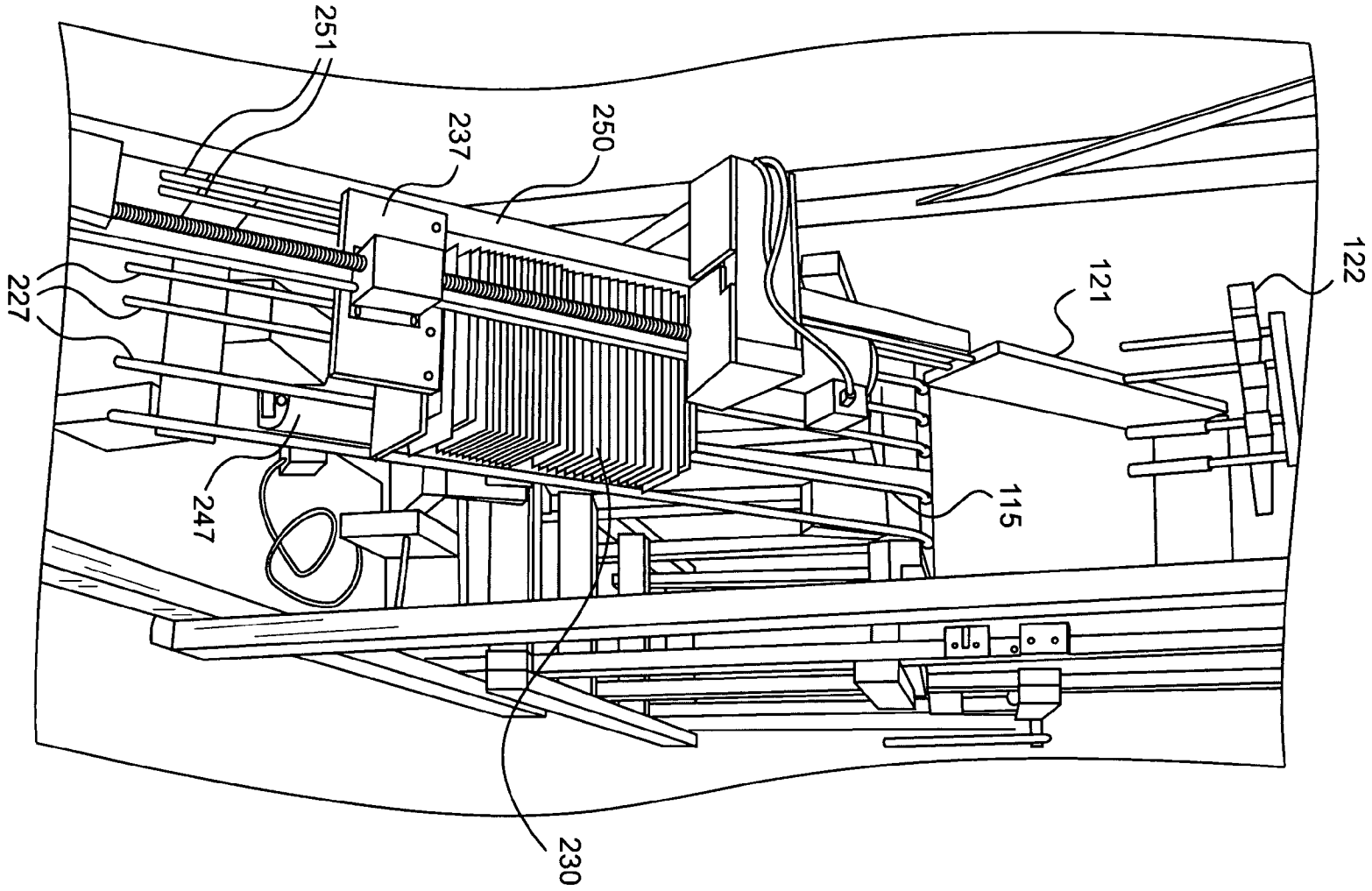
FIG. 2 is a diagram depicting a decline slide.
Figure 3:
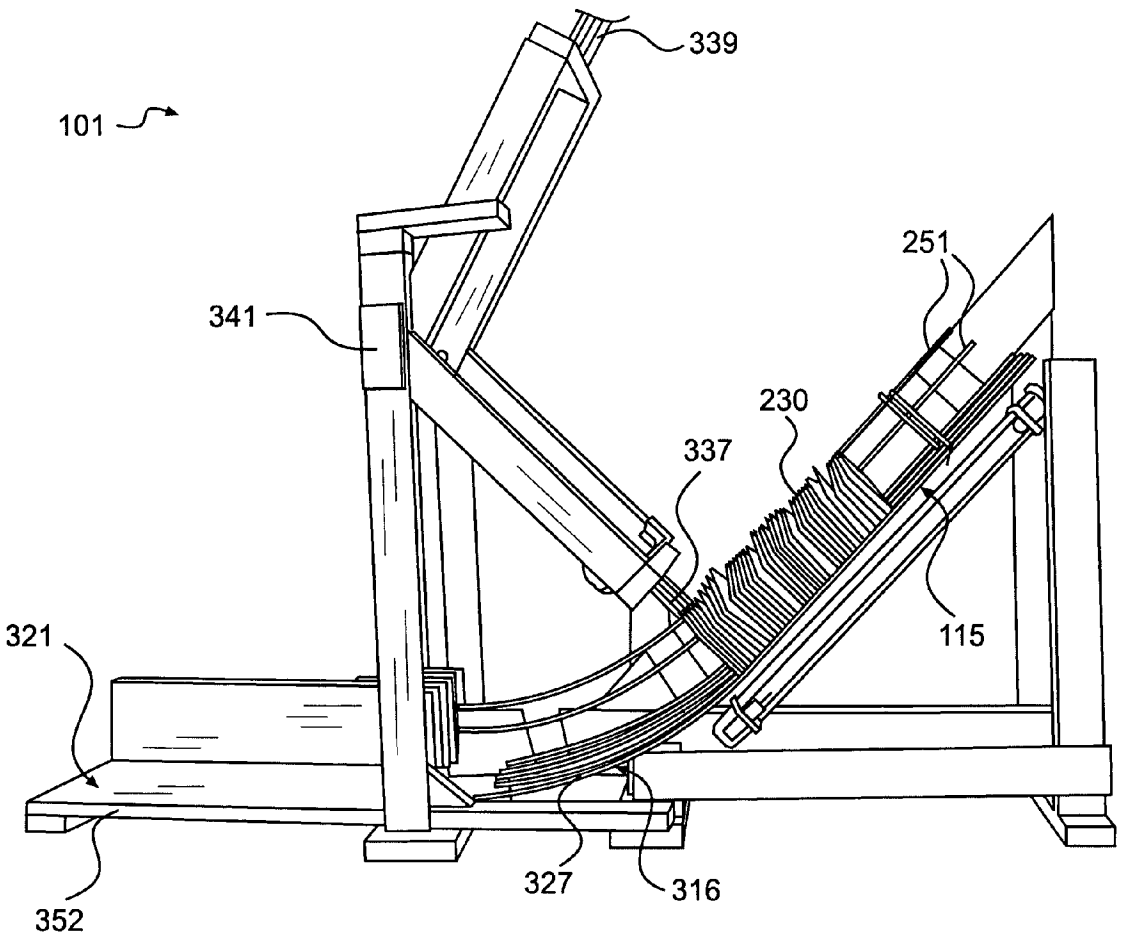
FIG. 3 is a diagram depicting the decline slide and a transition slide.

FIG. 2 depicts decline slide 115 and FIG. 3 depicts transition slide 316. Transition slide 316 in turn connects to feed table 321. As depicted in FIGS. 2 and 3, the decline and transition slides 115, 316 are modules which are formed from multiple tubes 227, 327 placed in the proper configuration to support mail slugs 230 during transfer operations. Decline slide 115 is mounted at an angle of approximately 45 degrees, which provides excellent control of the mail, and gravity provides the motive force to advance the mail slug 230. Decline slide 115 includes decline slide frame 250 to which are mounted decline support side rails 251, which assist in edging the mail slug 230.

Support combs, such as leading decline slide comb 237, leading transition slide comb 337 and trailing transition slide comb 339, are used to control the transfer of the mail slugs 230. Combs 237, 337 and 339 are shown positioned above the respective decline and transition slides 115, 316; however, the combs may be mounted below or above the slides 115, 316. Transition slide combs 337, 339, mounted through a common pivot point 341, control the transfer of the mail slug 230 through transition slide 316, returning the mail to the horizontal plane defined by a floor plate 352 floor of feed table 321.

Figure 4:
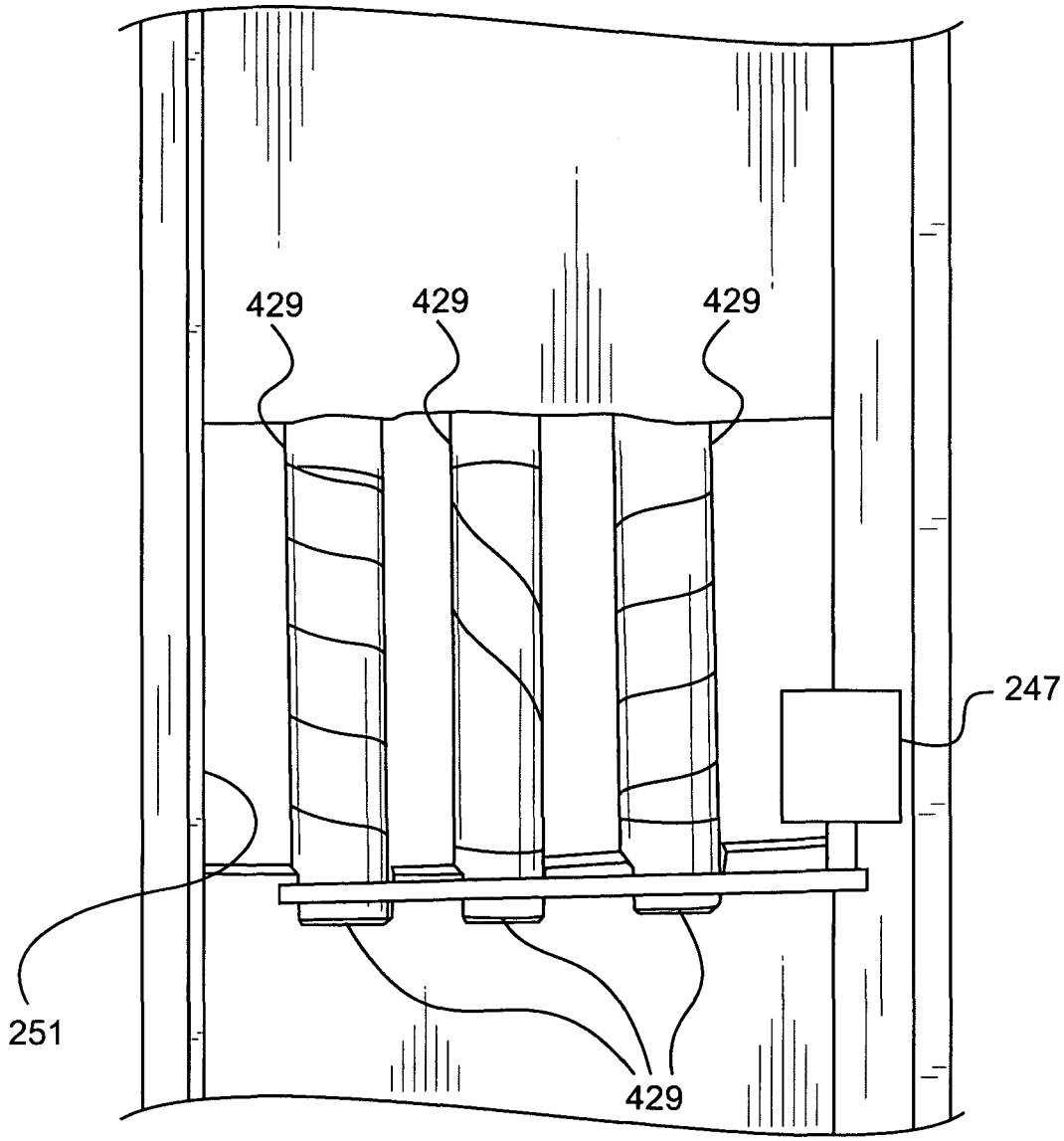
FIG. 4 is a diagram of an edger apparatus.
Figure 5:
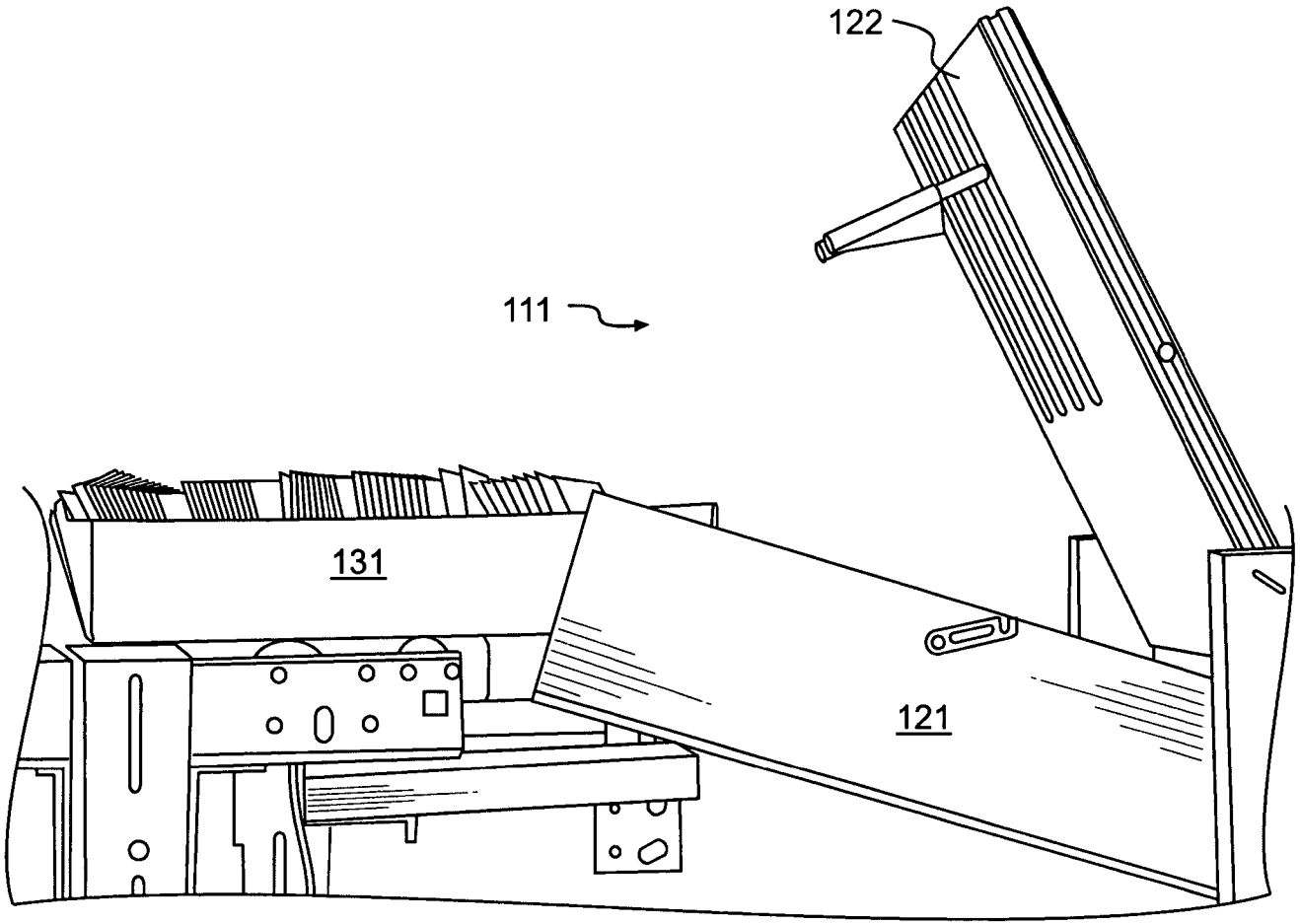
FIGS. 5-7 are diagrams depicting a tray received by a flip unloader box.
Figure 6:
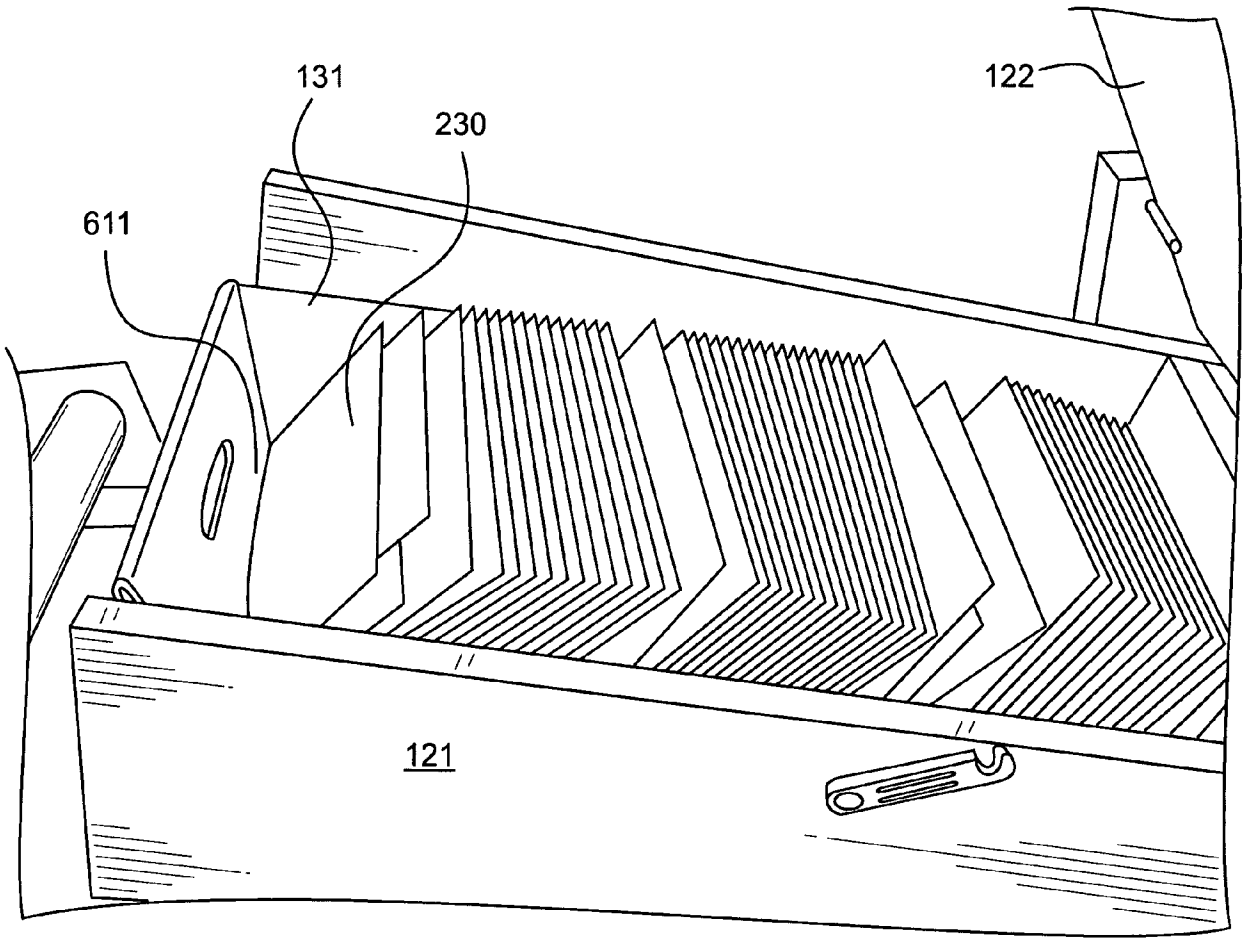
Figure 7:
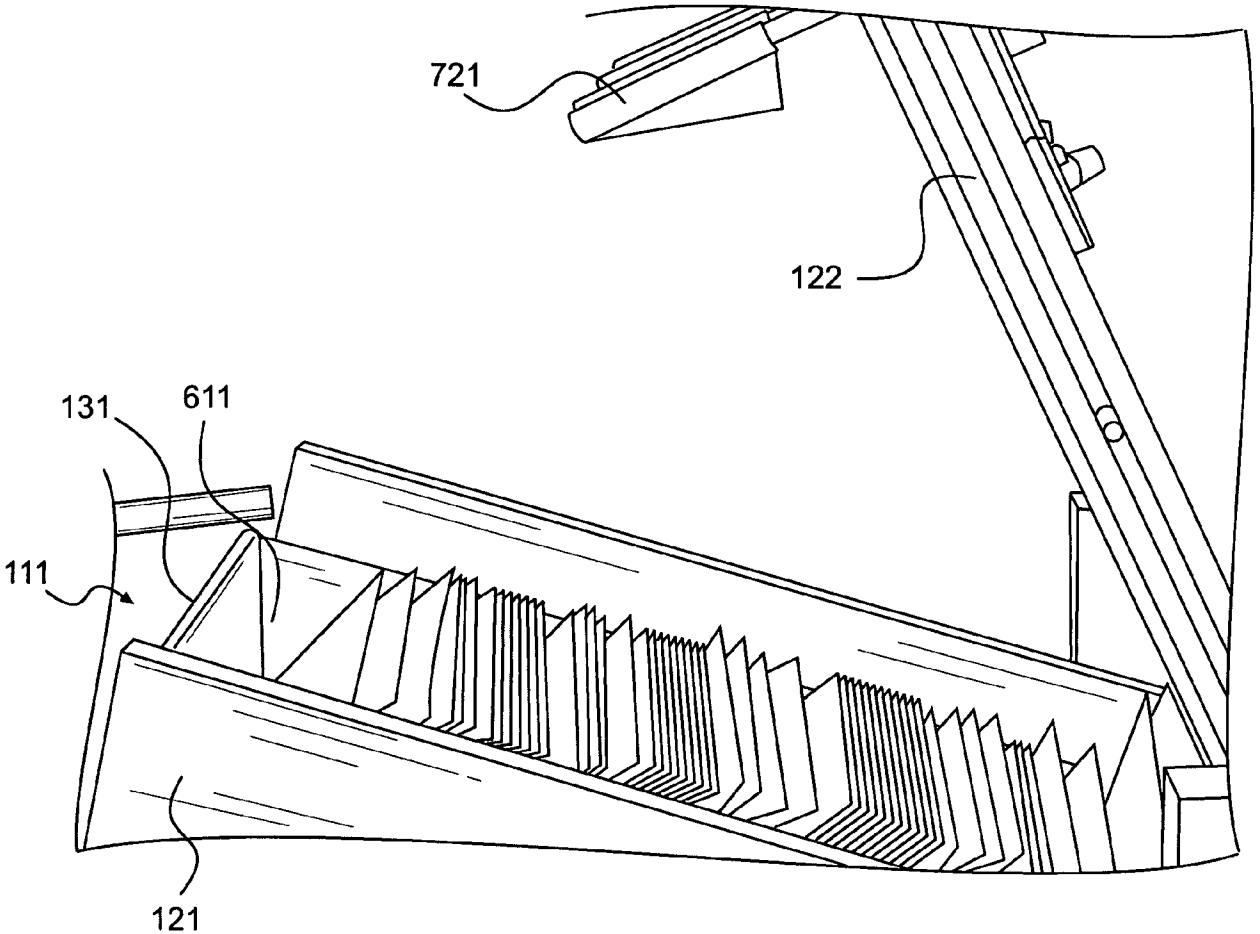
Figure 8:
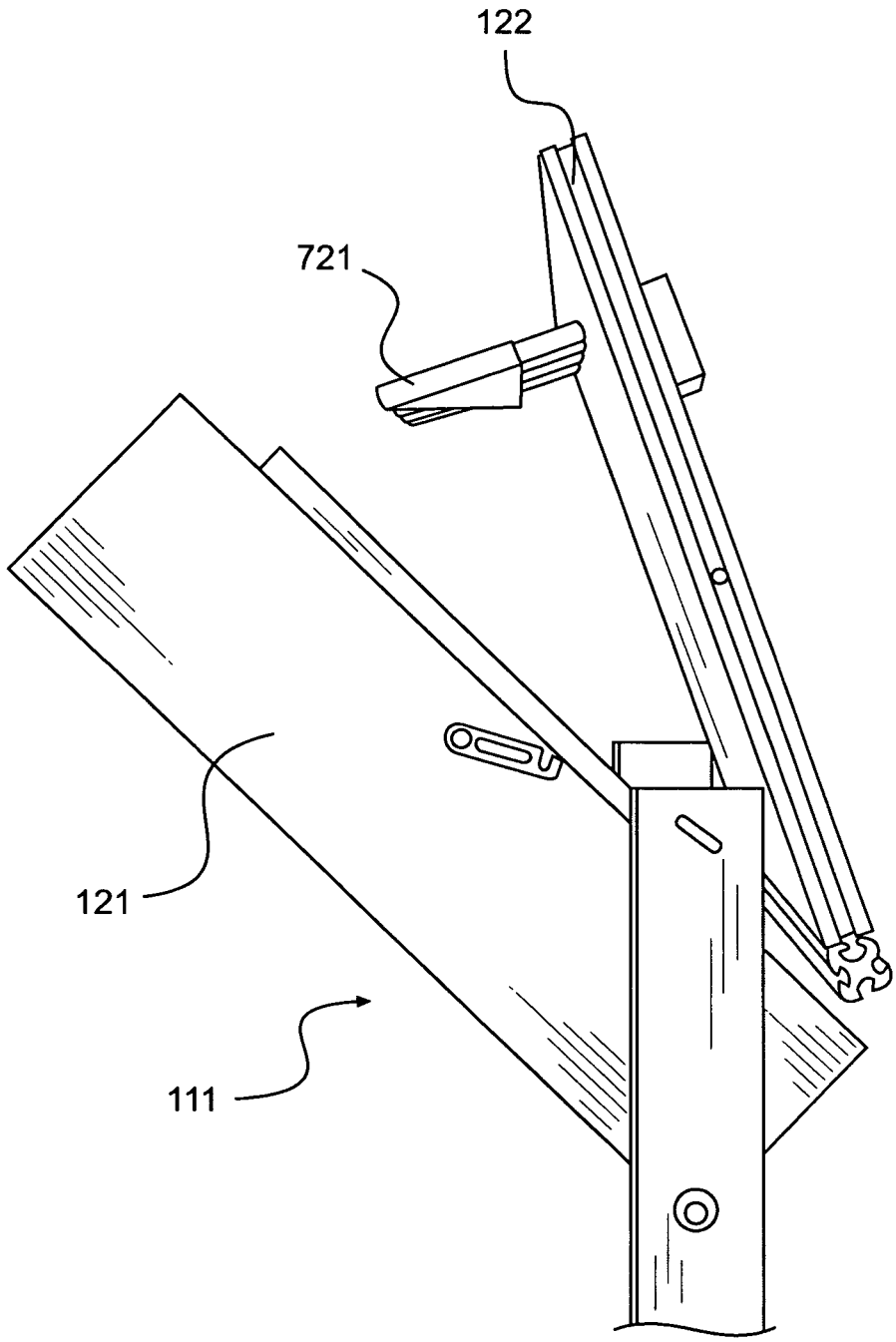
FIGS. 8 and 9 show the flip unloader box closing over the tray.

FIG. 4 depicts edging rollers 429 forming three lagged rollers. Edging rollers 429 are placed in the bottom of a slide positioned approximately 45 degrees from the horizontal, and mounted perpendicular to the direction of mail travel. A small motor 247 provides power to the tubes, which are interconnected via a belt drive (not shown). As the mail passed over edging rollers 429, the mail is urged to move against decline support side rails 251. This urging against side rails 251 assists in edging the mail.

The edging can occur at flip unloader 111, on decline slide 115, on another portion of the pathway or in any combination of these locations. One advantage of using flip unloader 111 for edging is that the mail is generally able to move more freely within flip unloader 111, so that edging can take place on a more consistent basis. Providing additional edging on decline slide 115 compensates for a possible tendency for mail in the mail slug 230 to shift away from its edged condition.

An advantage of the use of tubes, such as tubes 227 as bottom supports for the mail slugs 230 is that the tubes allow mailpieces to drop through. In the case of mail in slugs 230, this would not occur, but if a mailpiece becomes separated from the slug 230, it is likely to drop past the tubes 227 rather than remaining in the operational path of the mail transfer apparatus 101. This separated mail can include mail which ends up in the trays 131 in the lengthwise orientation of the tray. The ability of improperly oriented mail to fall through the tubes 227 reduces the possibility that such stray mailpieces will get mangled or possibly jam the mail sorting equipment as a result of a misfeed. The stray mailpieces may then be retrieved from the floor or a catch tray (not shown) and placed back in the mail sorting line.

Tray Unloading

In an example operating environment, the trays 131 are diverted to a feeder/singulator spur. The trays 131 are provided unsleeved and in proper orientation.

The apparatus 101 works equally well with full and half trays 131. Only depictions of processing full trays 131 are included in this section for brevity.

As depicted in FIGS. 5-9, unsleeved trays 131 enter the flip unloader box 121. At that time, flip unloader 111 is positioned on an incline to receive trays 131. As one of the trays 131 enters, the mail is shifted forward, opening a space 611 between the uphill end of tray 131 and the mail slug 230.

Figure 9:
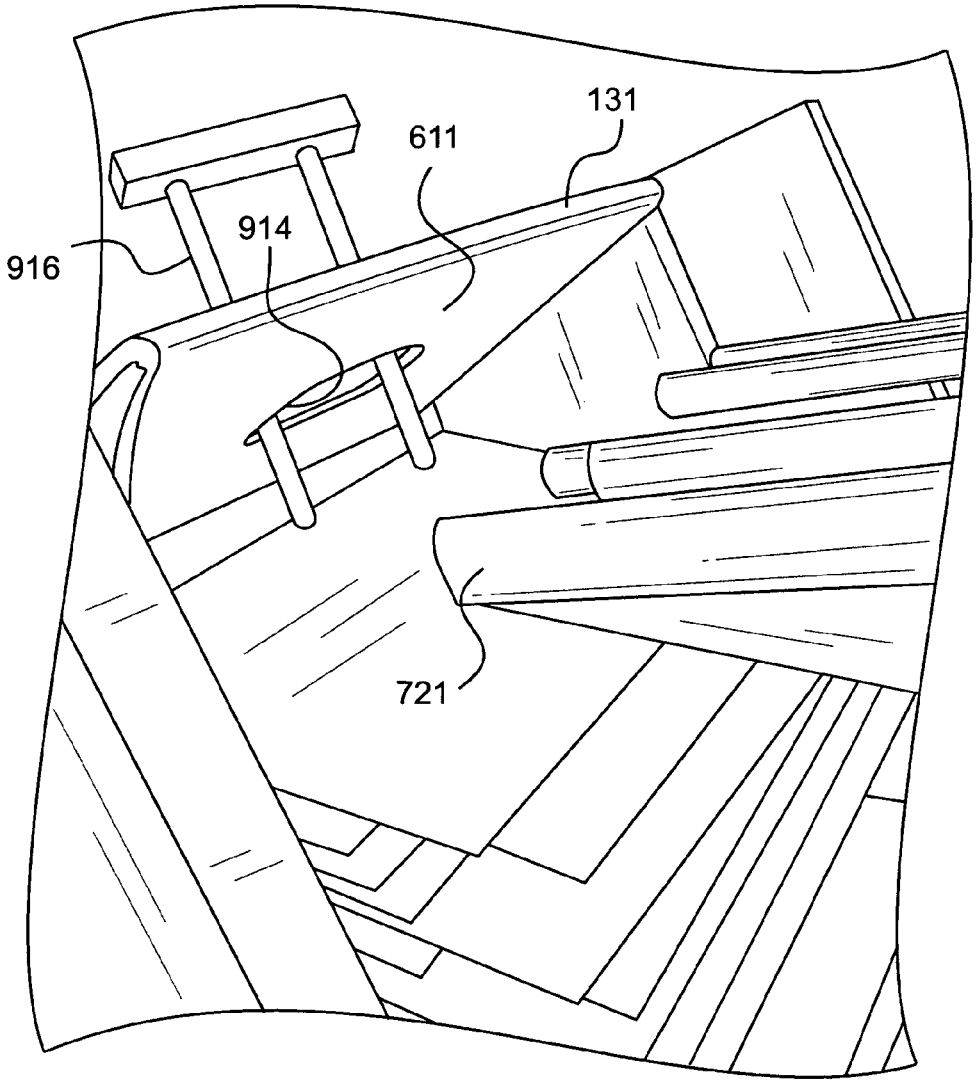
Figure 10:
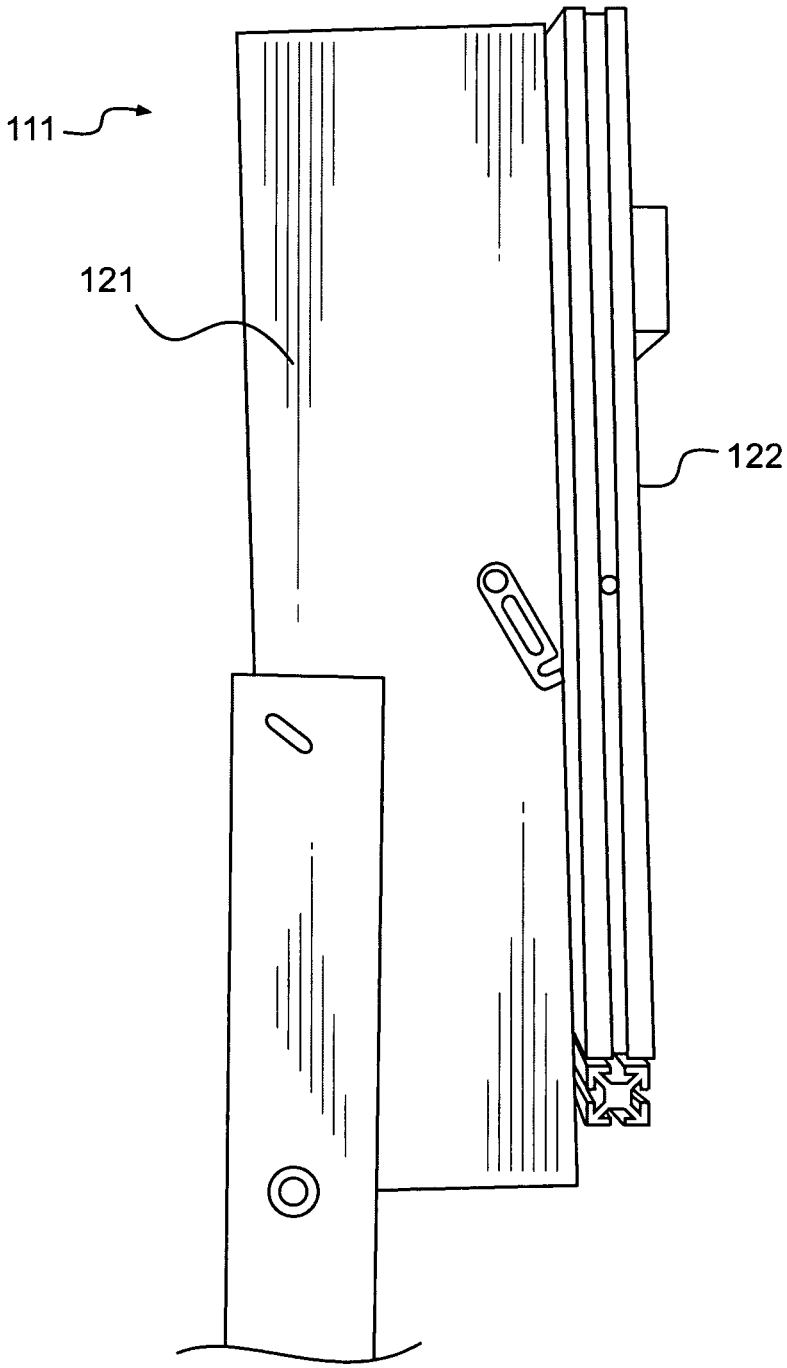
FIG. 10 is a diagram showing rotation of the flip unloader.

As depicted in FIGS. 9 and 10, box 121 rotates approaching lid 122. As flip unloader 111 continues to rotate, a comb paddle 721 mounted to lid 122 enters the space 611 between the tray 131 and the mail. Hand hole 914 can be used to assist by allowing a side prod 916 to press against the mail to establish space 611. Tray 131 typically is loaded so that space 611 would occur as a result of the tilt of tray 131; however, the provision of hand hole 914 allows the prod to press the mail to establish the space 611.

Figure 11:
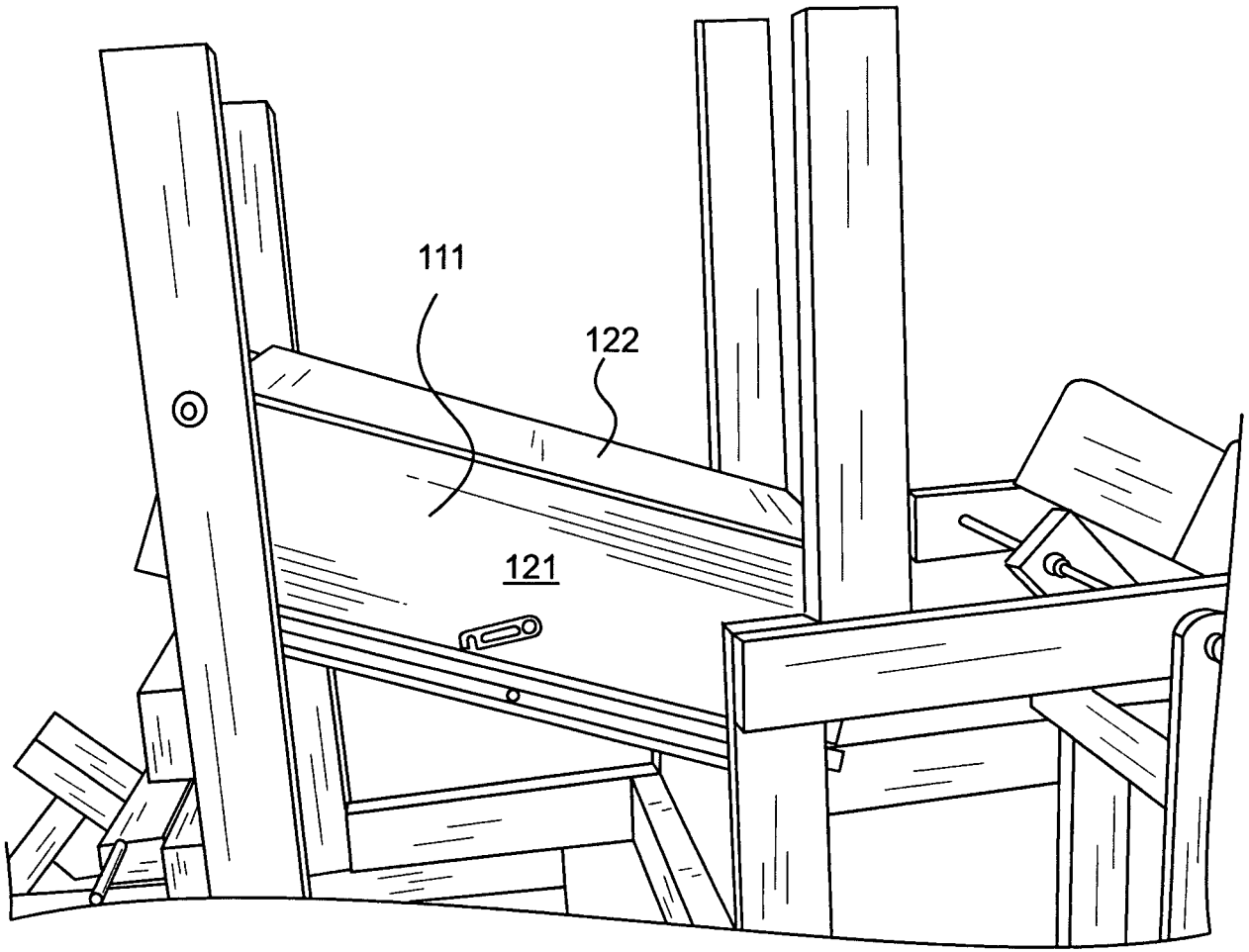
FIG. 11 is a diagram depicting the flip unloader rotated past a horizontal position and on a slight incline.

Referring to FIG. 10, the closed flip unloader 111 continues to rotate, passing horizontal and stopping on a slight incline, as depicted in FIG. 11. At this point, flip unloader box 121 is inverted.

Figure 12:
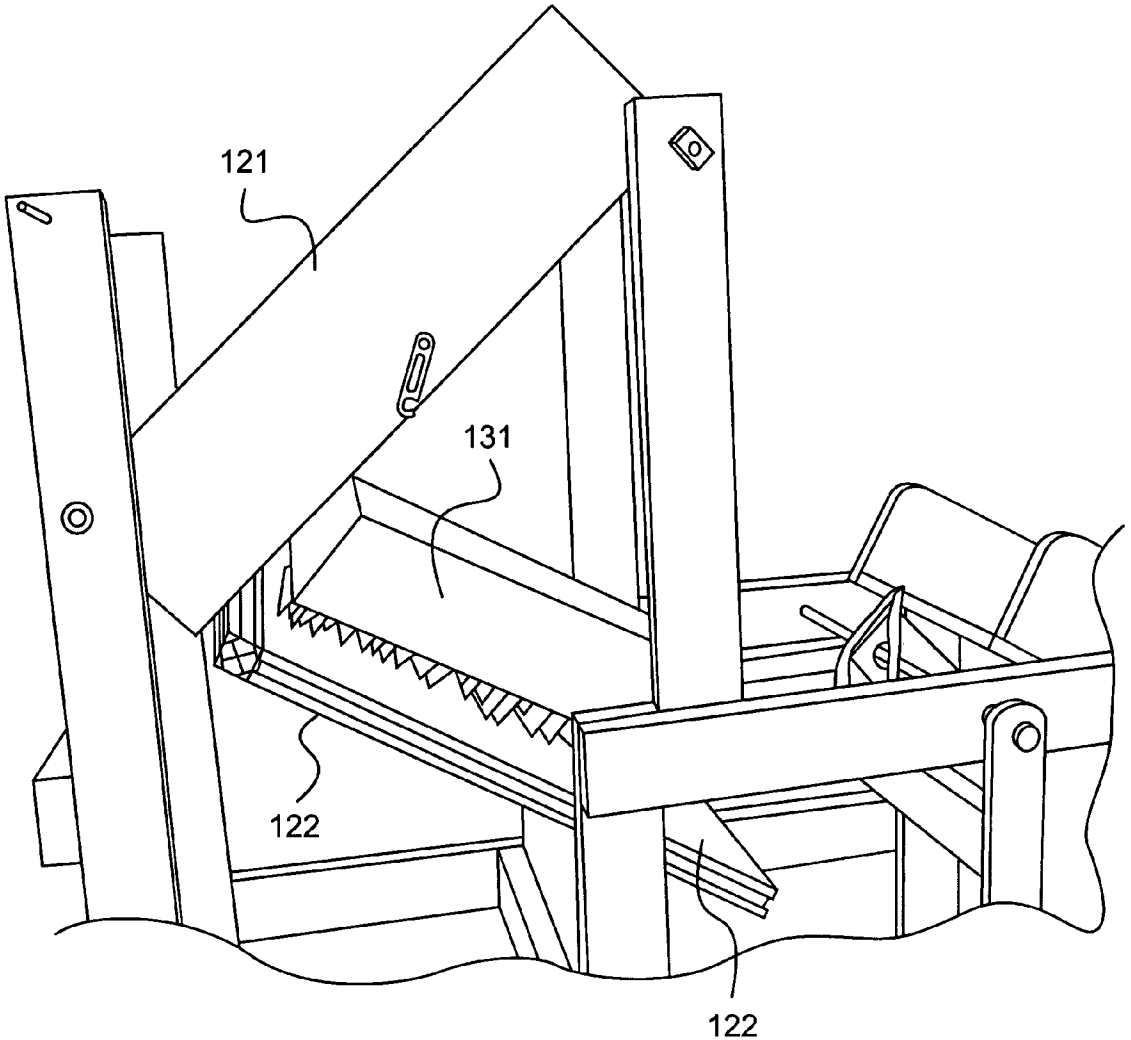
FIG. 12 is a diagram depicting the flip unloader box opening to expose the bottom of the tray.
Figure 13:
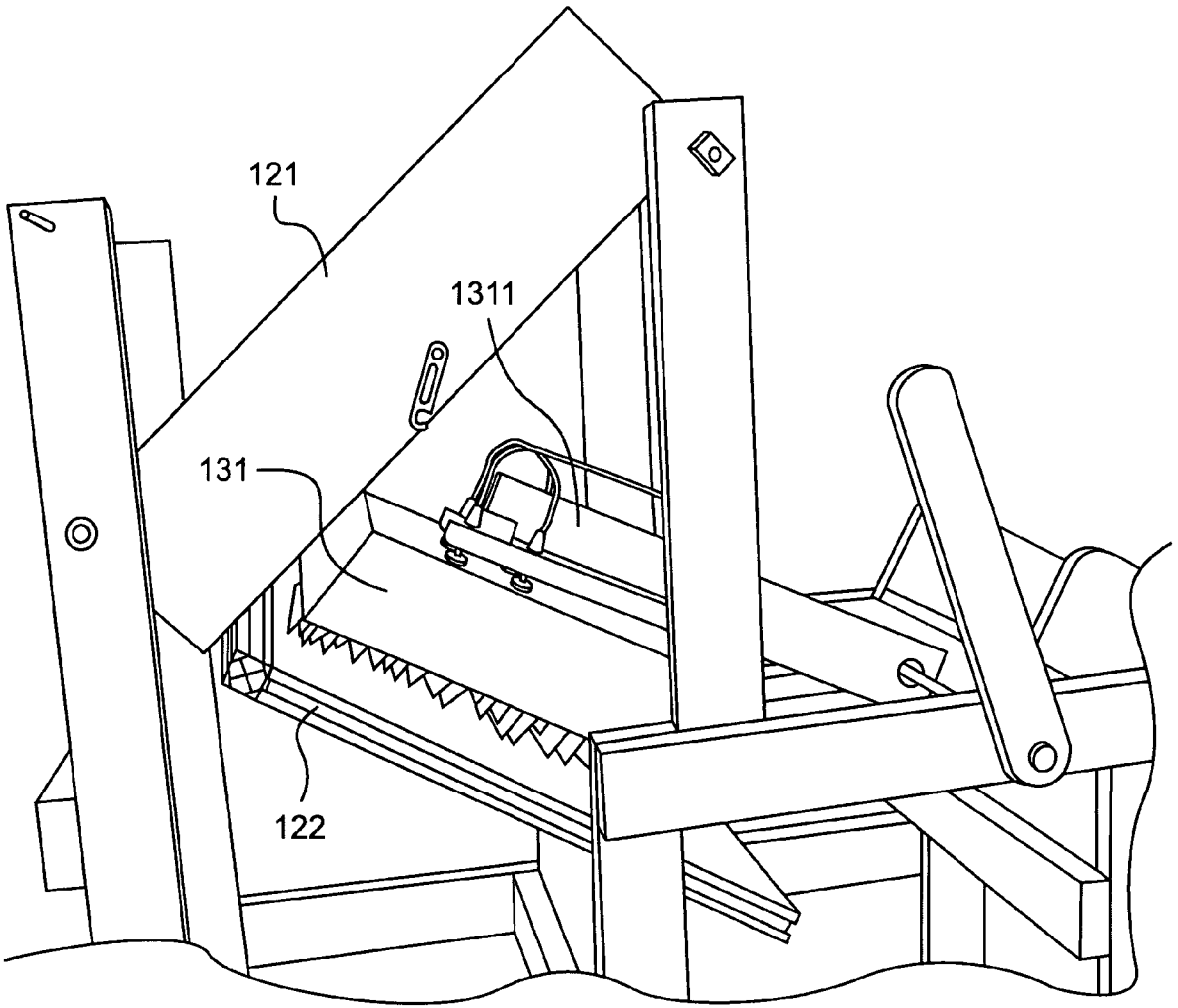
FIGS. 13-16 are diagrams showing the use of vacuum to lift the tray clear of a mail slug and move the tray to the empty tray discharge chute.
Figure 14:
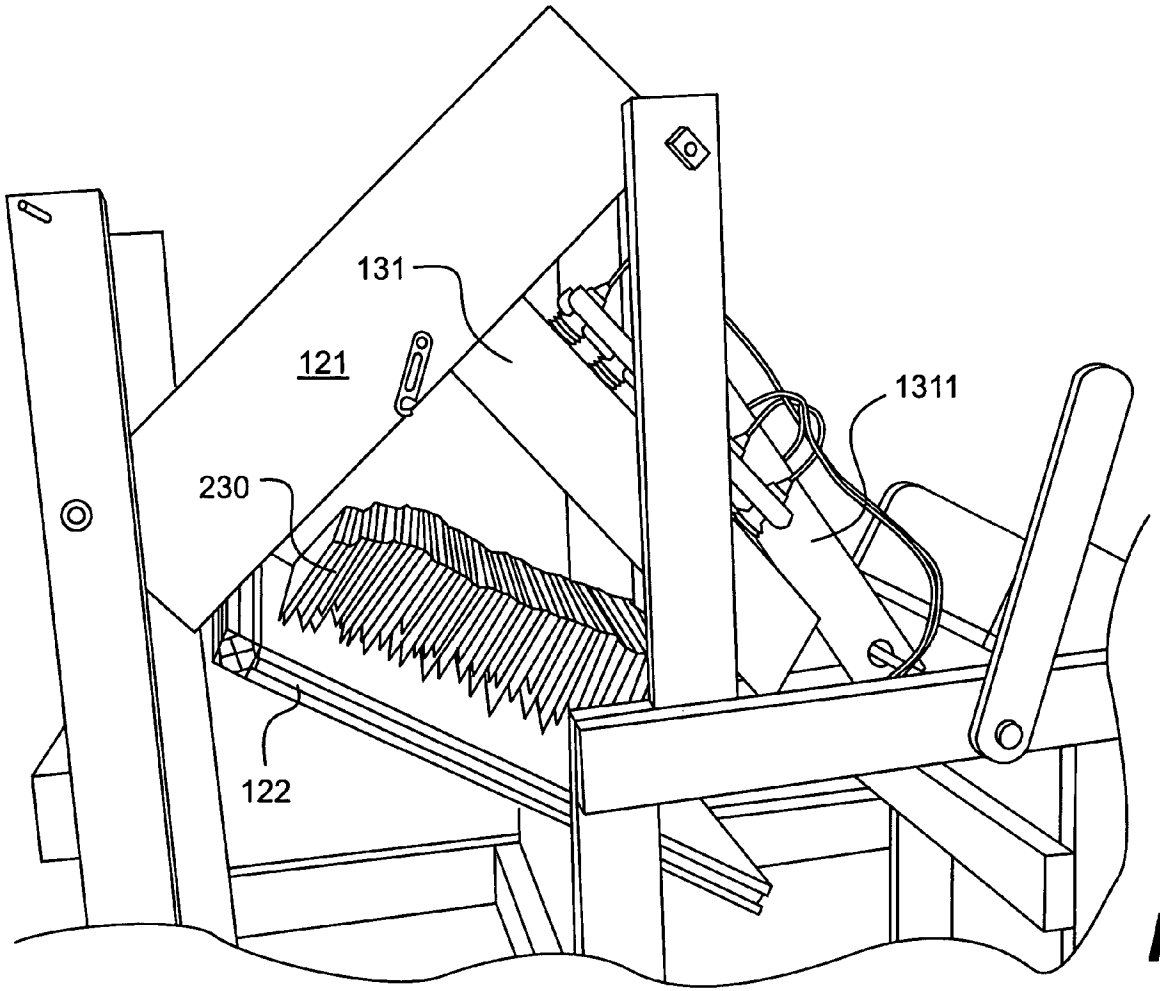

As depicted in FIG. 12, the flip unloader box 121 opens, exposing the bottom of the tray 131. In FIGS. 13 and 14, a vacuum head 1311 rotates into position on top of the tray 131.

Figure 15:
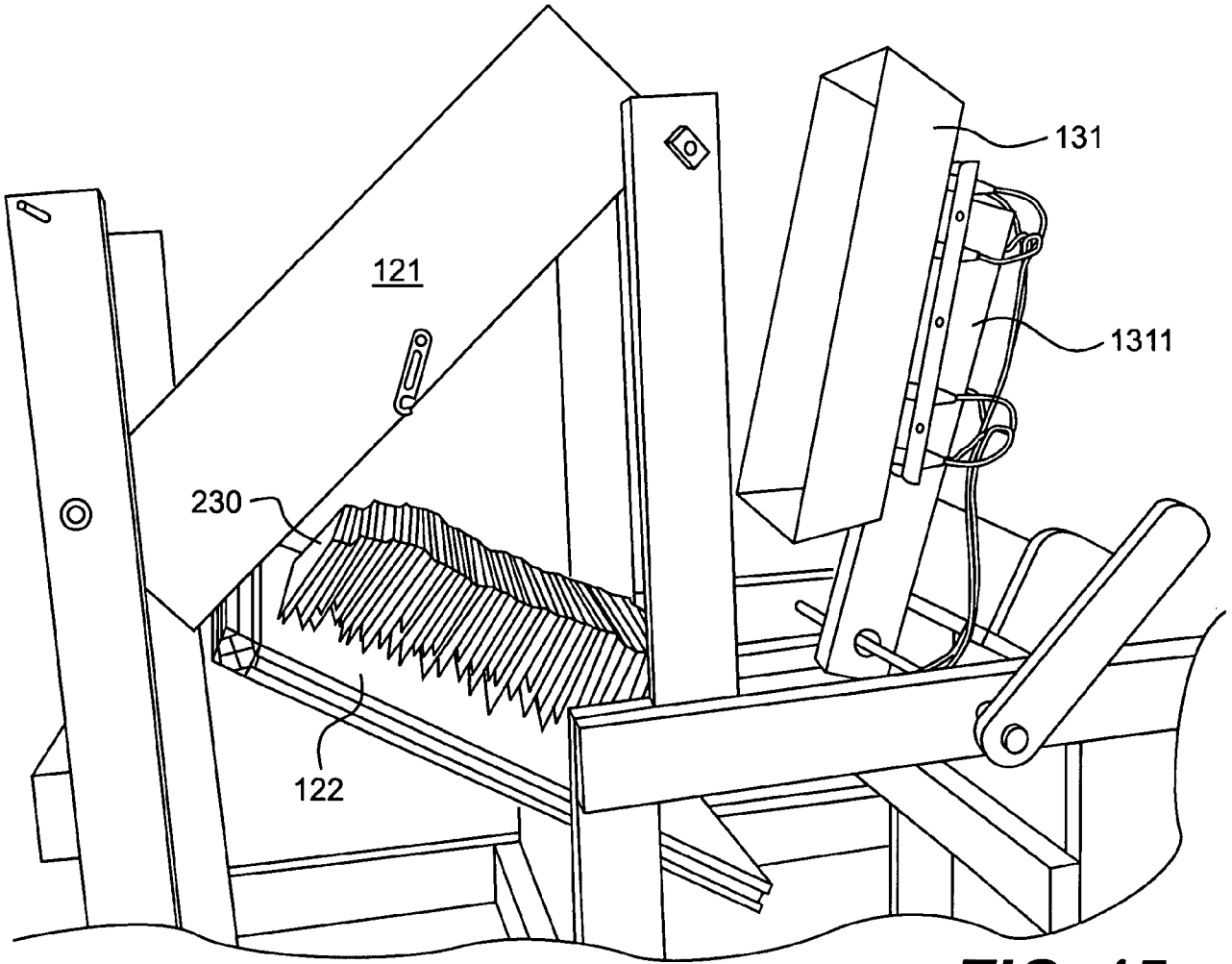
Figure 16:
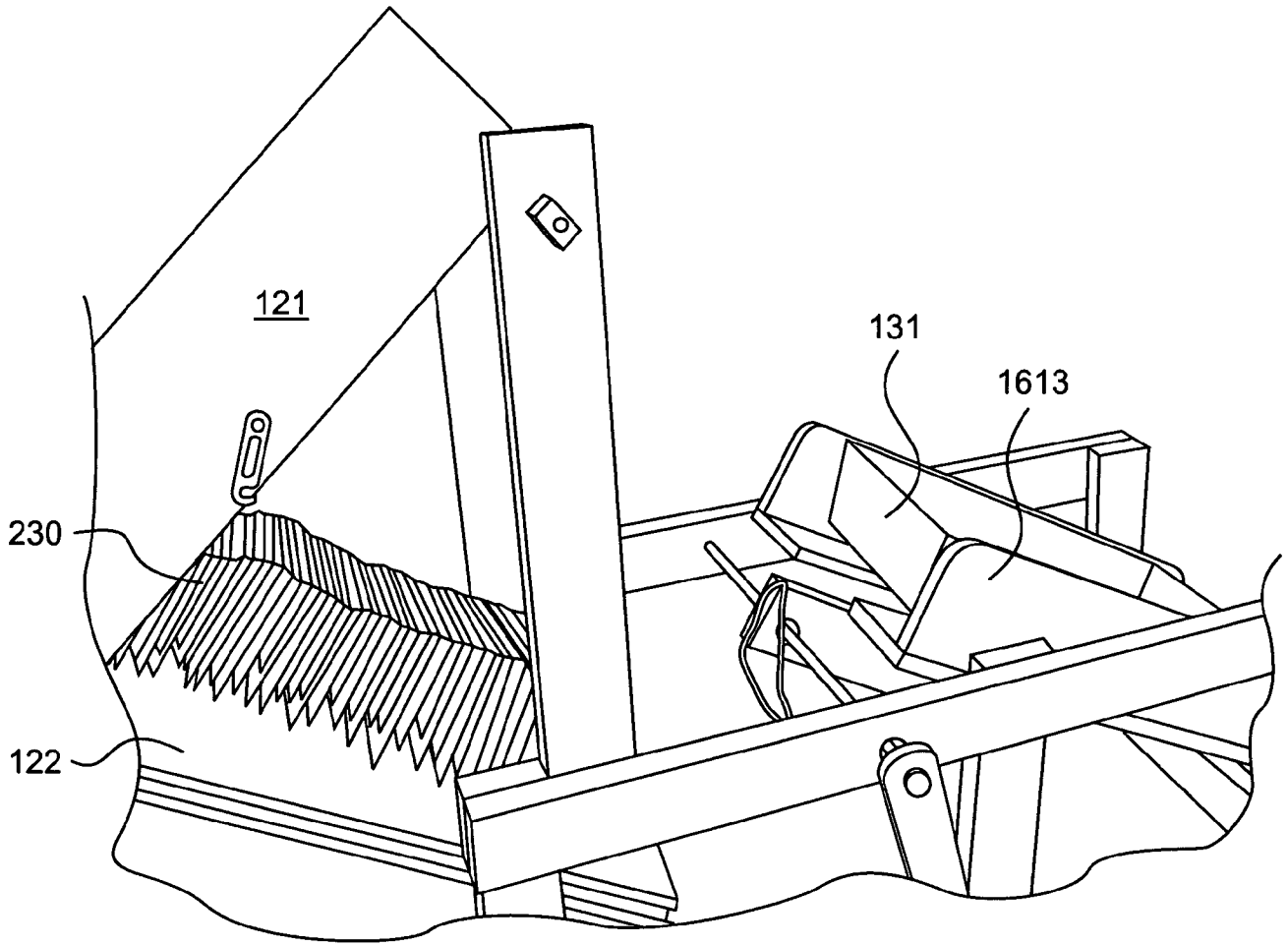
Figure 17:
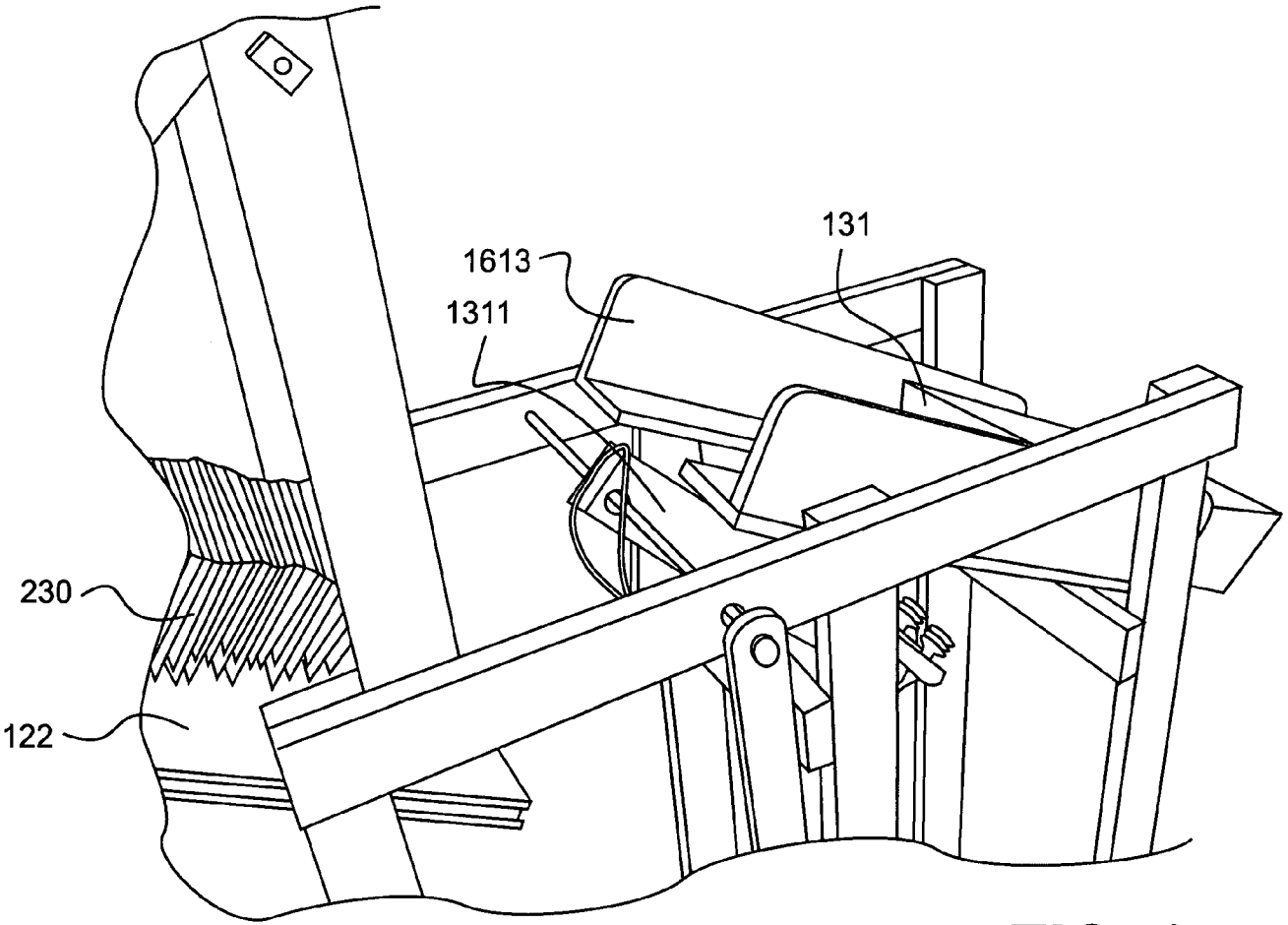
FIG. 17 is a diagram depicting release of the mail tray for discharge.

As depicted in FIGS. 14-16, the tray 131 is lifted clear of the mail slug 230 and moved to empty tray discharge chute 1613. The vacuum is disabled releasing mail tray 131, depicted in FIG. 17.

Figure 18:
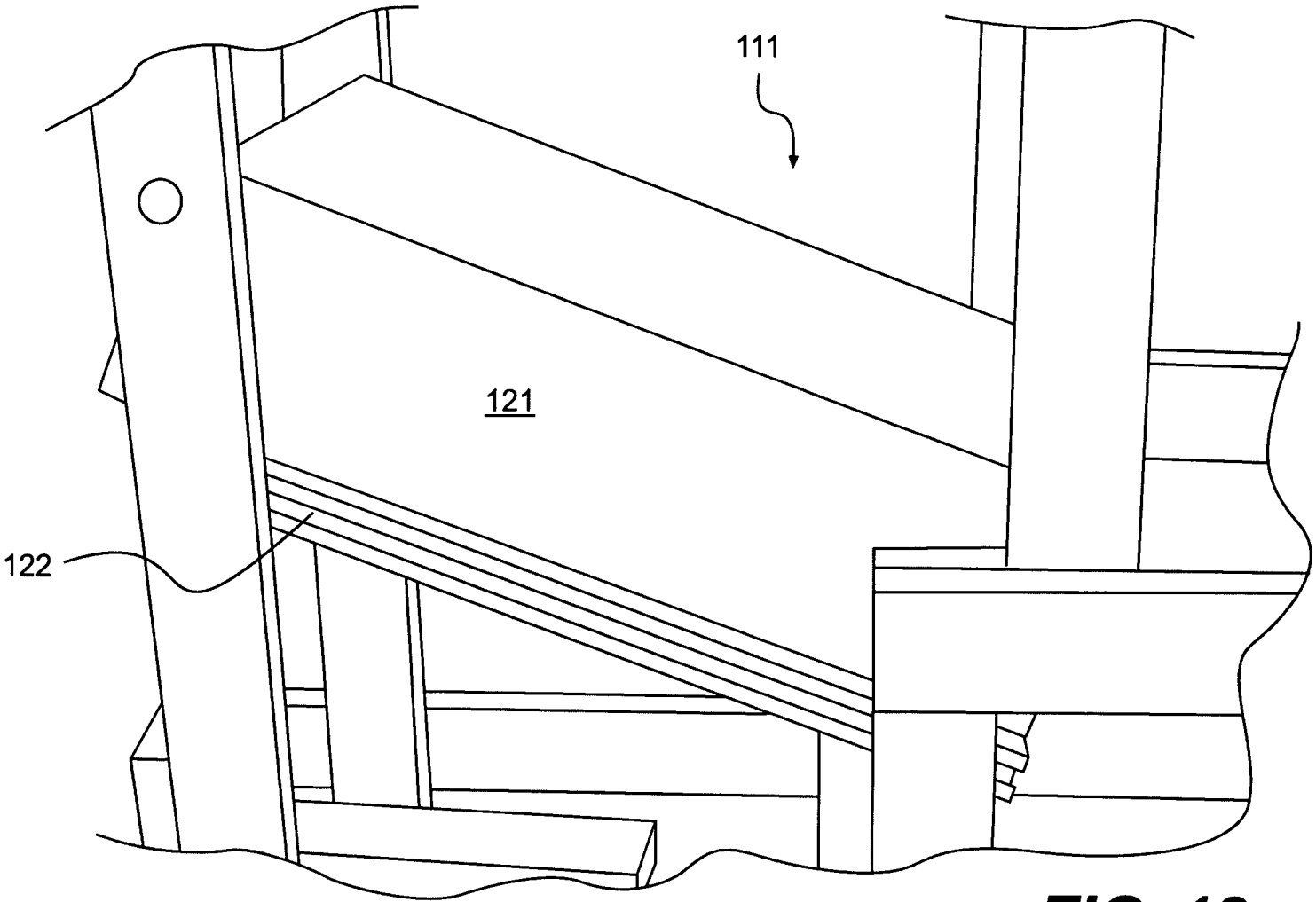
FIG. 18 is a diagram depicting the flip unloader box closing over the mail slug.
Figure 19:
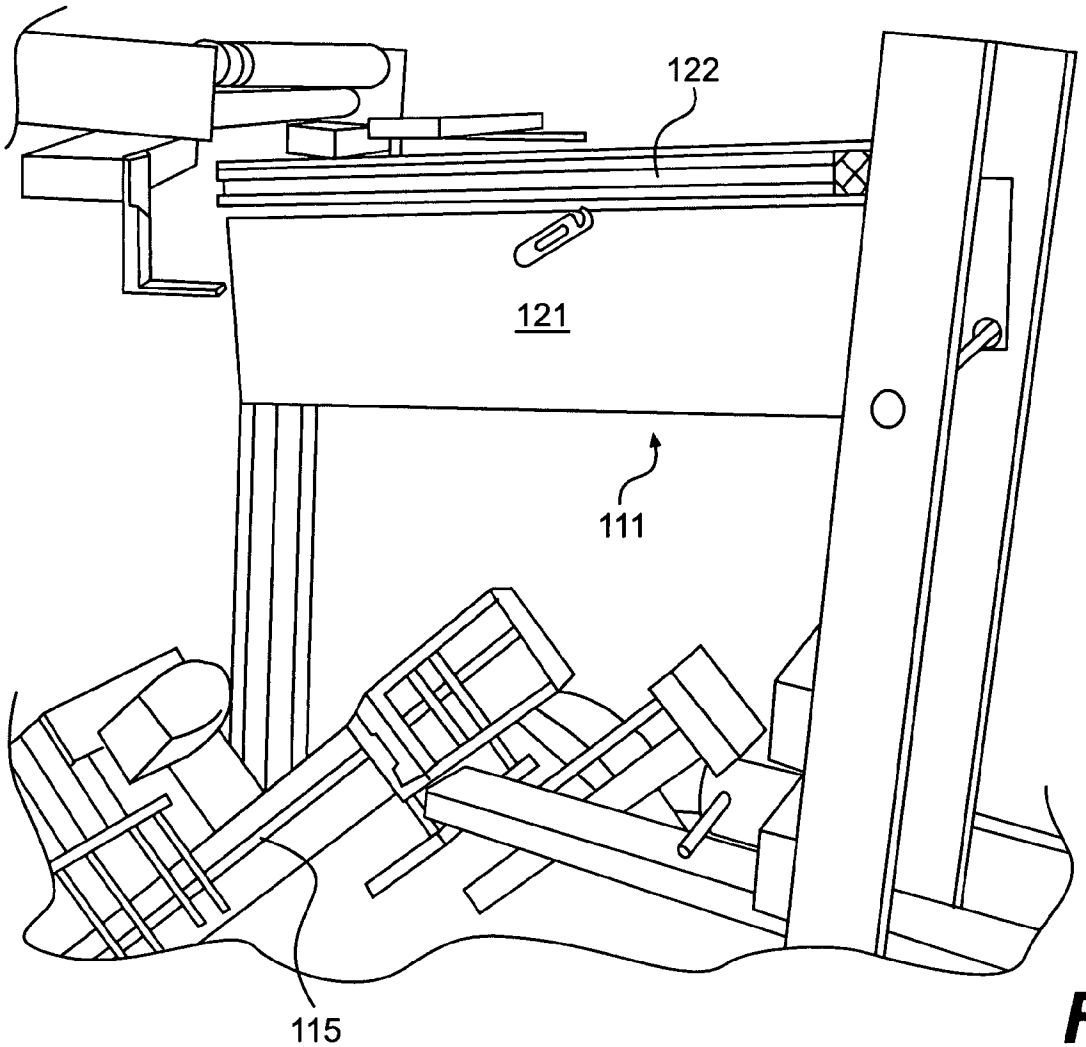
FIG. 19 is a diagram depicting the flip unloader box rotating prior to alignment with the decline slide.
Figure 20:
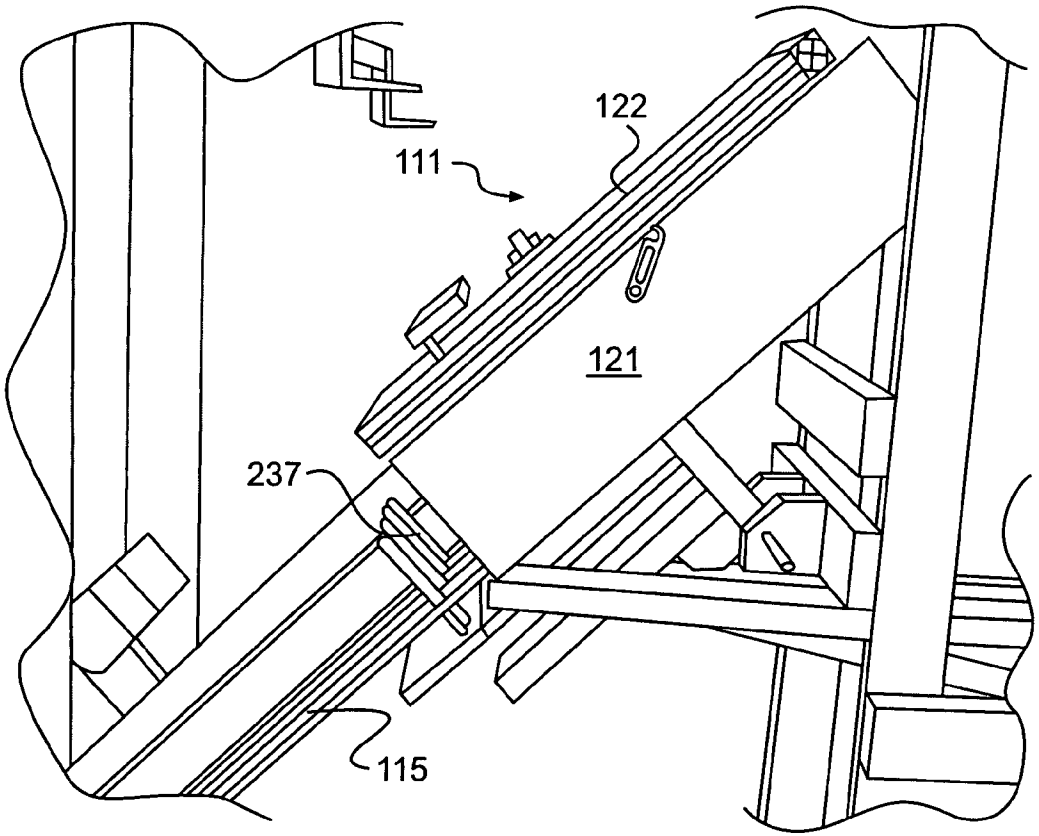
FIG. 20 is a diagram depicting the flip unloader stopped 45 degrees past horizontal, interfacing with the decline slide.

As depicted in FIG. 18, the flip unloader box 121 closes over the mail slug (230, not shown in FIG. 18). After flip unloader 111 is closed, the tray lid comb (721, not shown in FIG. 18) is indexed, securing the mail slug 230 between comb 721 and the flip unloader box 121, and also securing the mail in an edged condition. As depicted in FIGS. 19 and 20, flip unloader 111 rotates, stopping 45 degrees past horizontal, interfacing with decline slide 115. Flip unloader 111 at this time is generally in an upright alignment corresponding to the initial alignment, but at a different angle from the horizontal from that of the initial alignment. Thus, if the initial alignment (e.g., FIG. 1, 6 or 7) has the flip unloader box 121 tilted in an incline direction to allow the tray to enter, the alignment of flip unloader 111 interfacing decline slide 115 may be different. This is particularly true if, as depicted, the direction of movement of the tray is opposite that of the direction of movement of the mail when exiting flip unloader 111. The alignment of flip unloader 111 is also used to provide edging of the mail, so that, on discharge, the edged side of flip unloader 111 may be lower than the side that is not edged.

It is alternatively possible to leave the mail slug 230 inverted, in which case, the mail is discharged from the flip unloader 111 after the tray 131 is removed but without flipping the flip unloader 111 back to the upright position. This requires that subsequent handling either re-orient the mail or subsequent processing equipment accept the mail in an inverted orientation.

Movement of Mail from Flip Unloader

Figure 21:
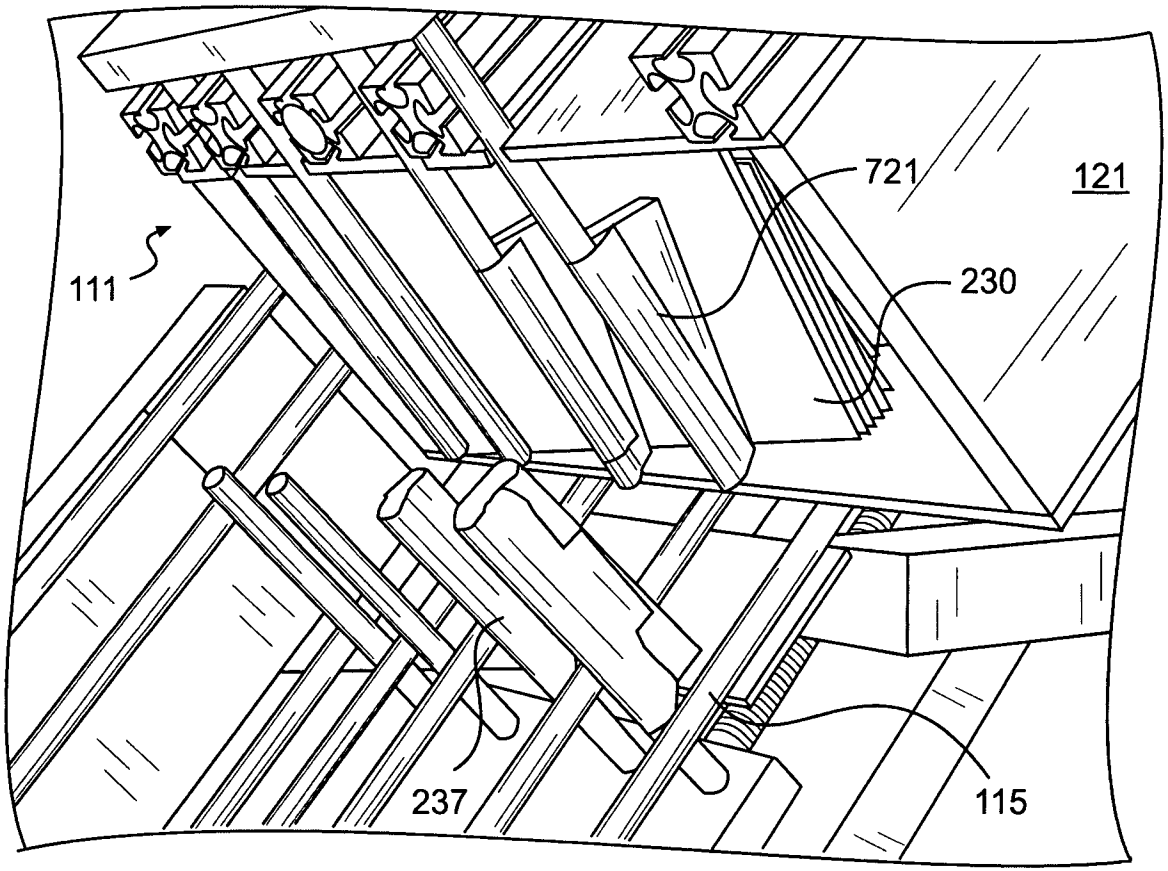
FIGS. 21 and 22 are diagrams showing engagement of the comb paddle with the mailpieces in the flip unloader.
Figure 22:
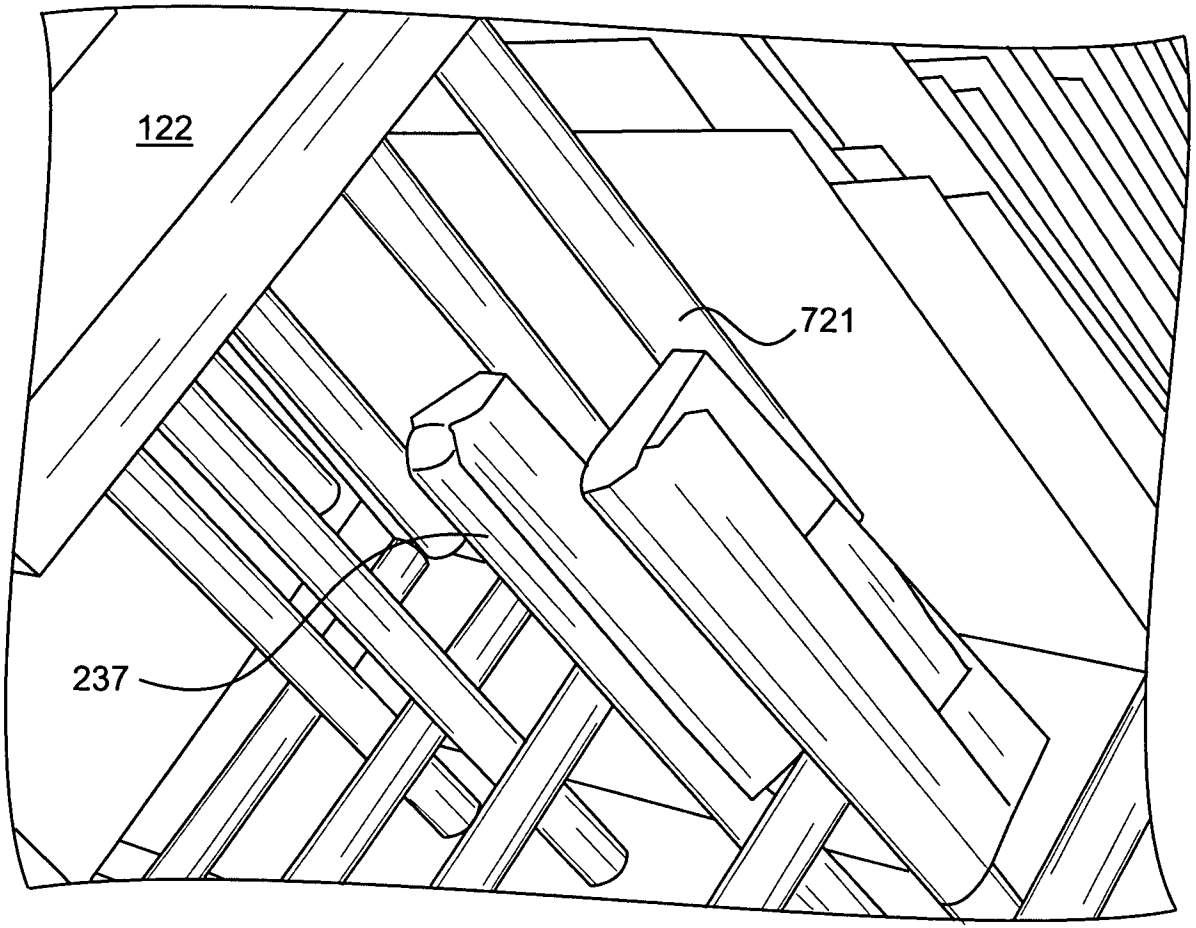
Figure 23:
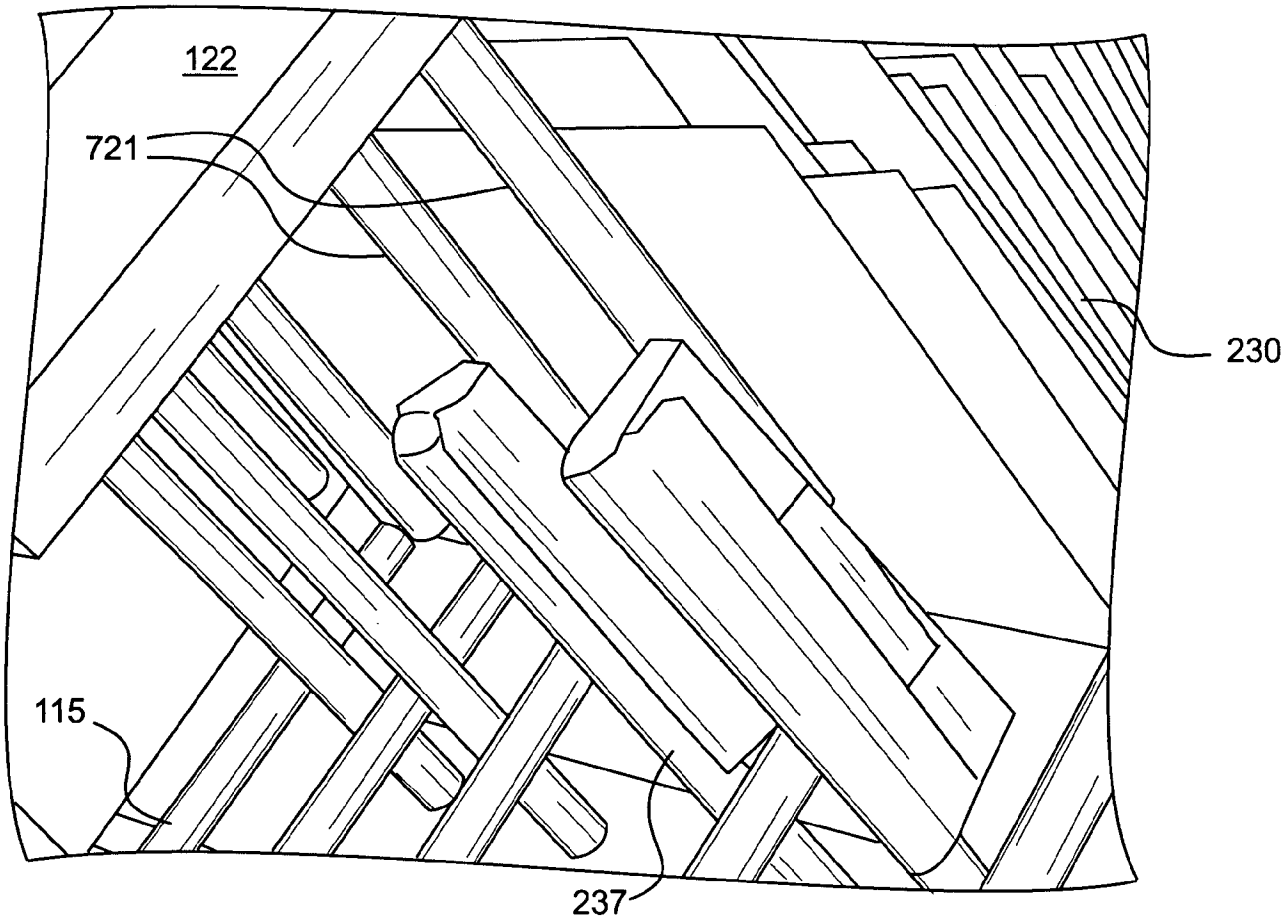
FIG. 23 is a diagram depicting the lid comb passing through the decline slide comb, transferring the mail slug to the decline slide comb.

FIGS. 21 and 22 show the engagement of comb paddle 721 with the mailpieces in flip unloader 111. Referring to FIG. 23, as the comb paddle 721 swings upward with lid 122, mail slug 230 is transferred to decline slide 115. As depicted in FIGS. 22 and 23, comb paddle 721 passes through the decline slide comb 237, transferring the mail slug 230 to decline slide comb 237. Decline slide comb 237 permits the mail slug 230 to descend down decline slide 115 in a controlled manner. By descending in a controlled manner, the mailpieces are prevented from scattering.

Figure 24:
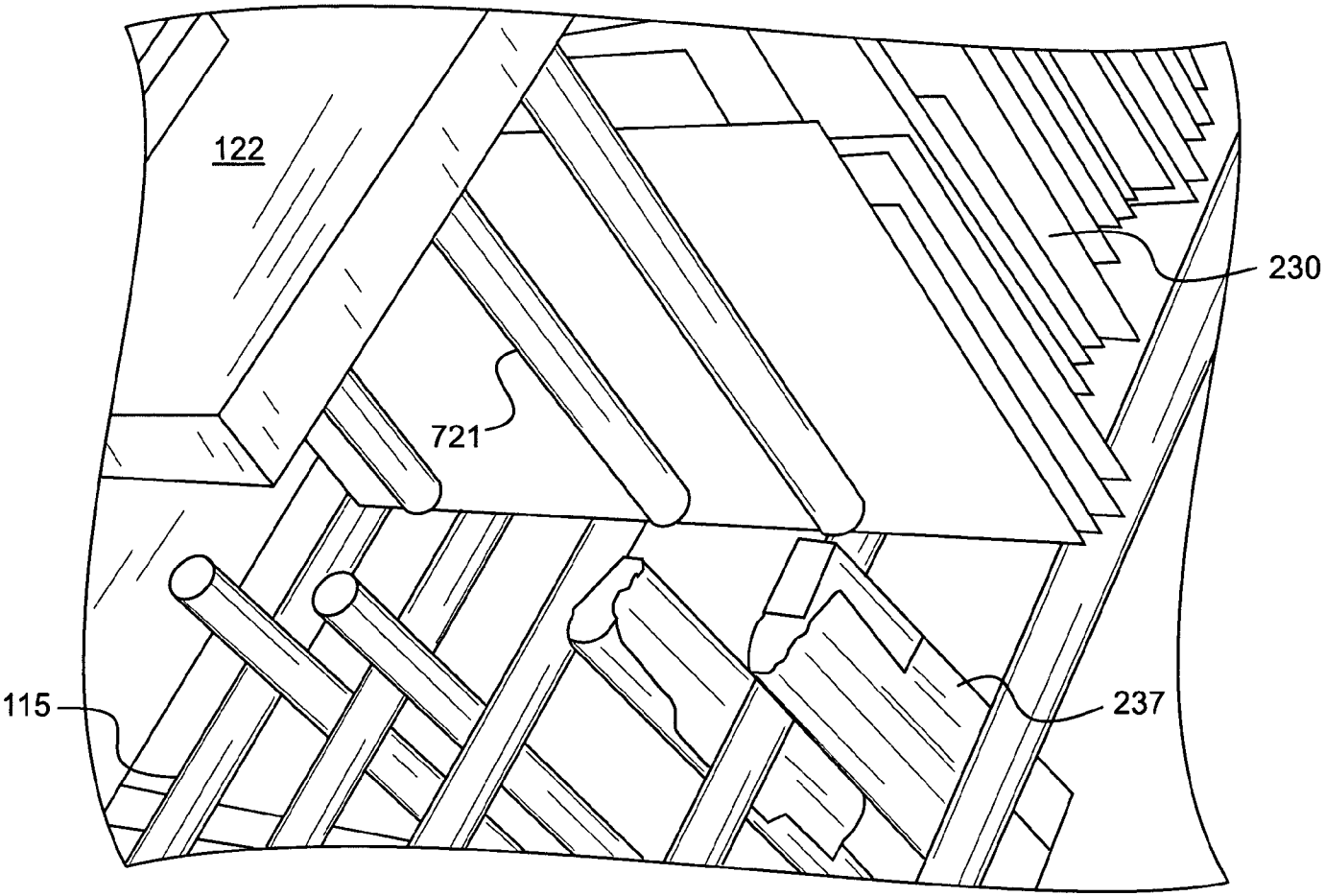
FIGS. 24-30 are diagrams depicting movement of the mail slug as guided by the combs.
Figure 25:
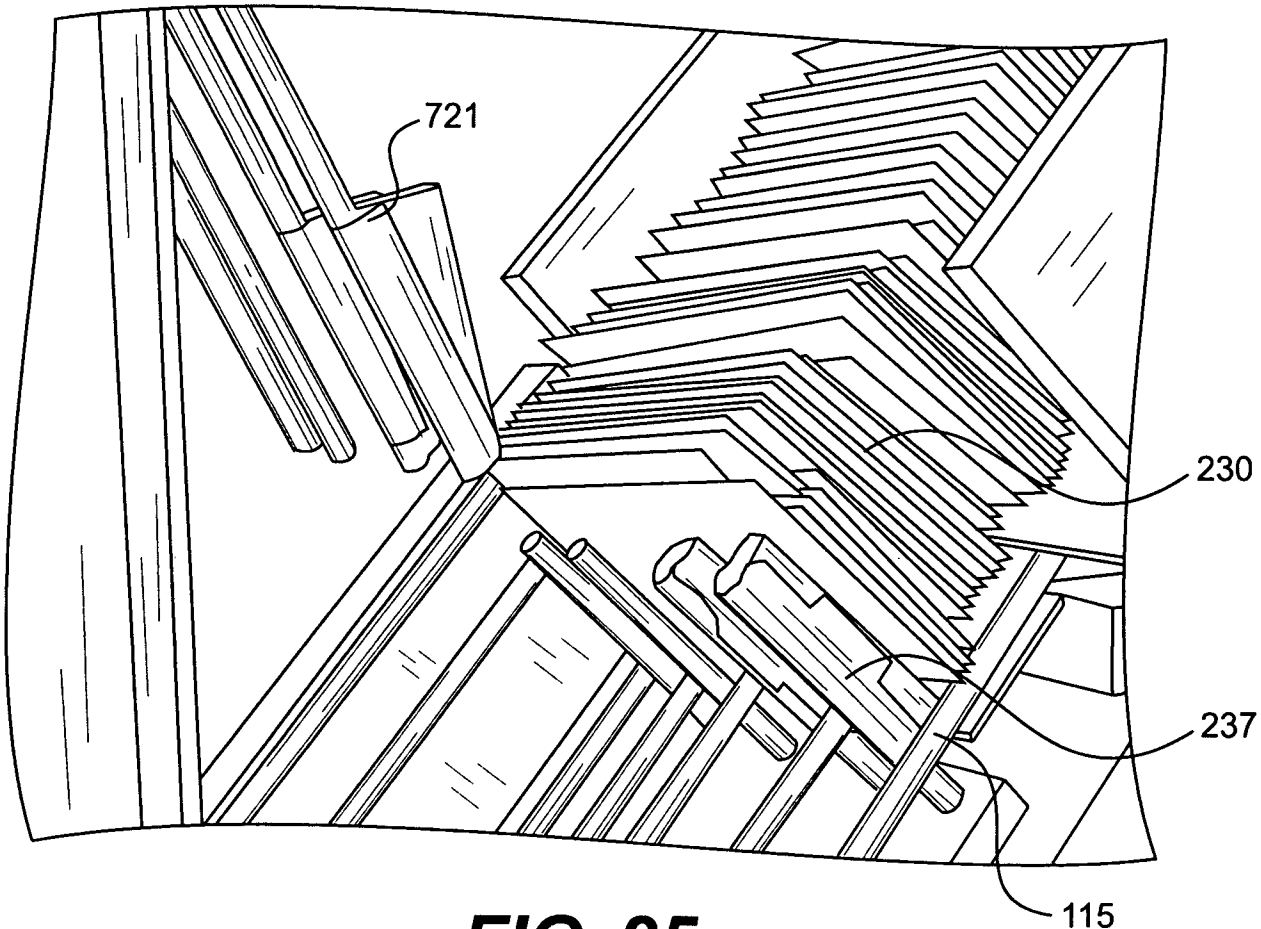
Figure 26:
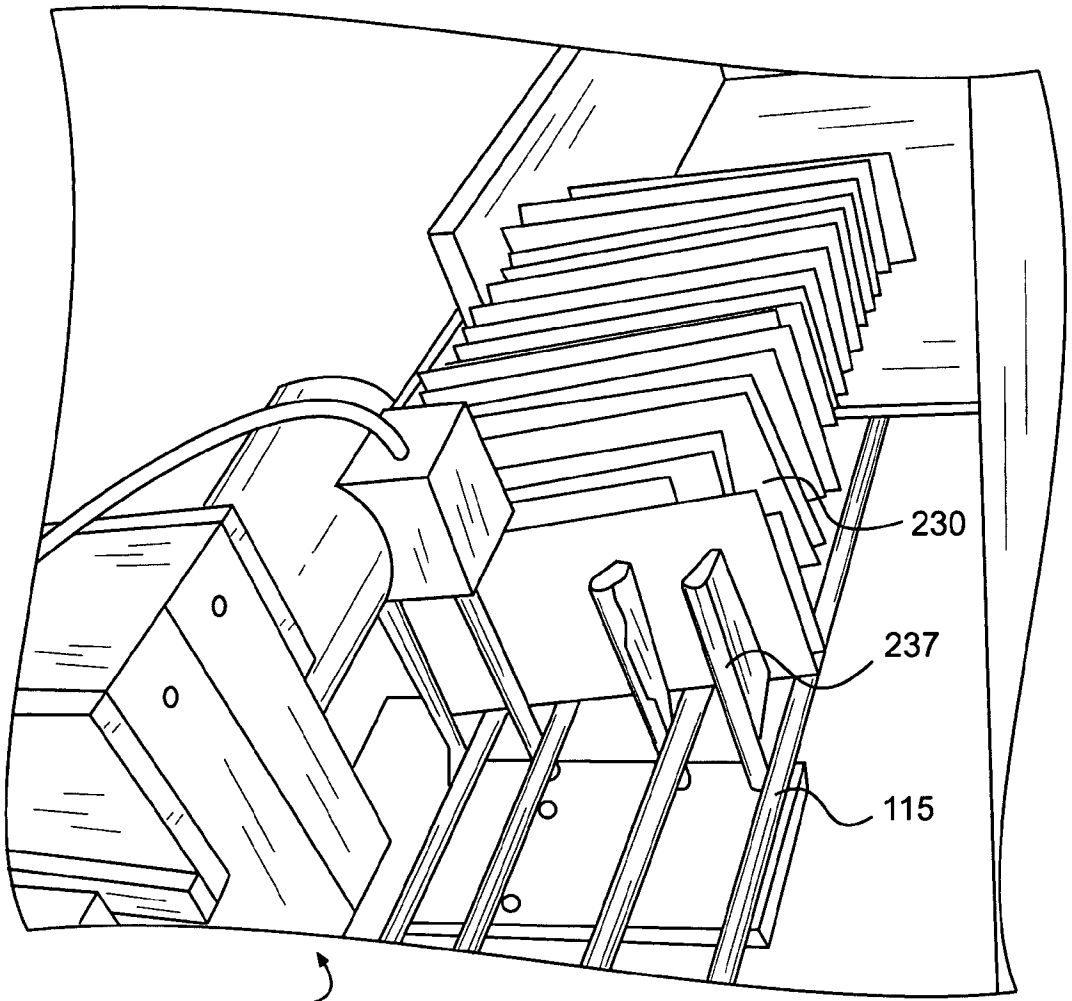
Figure 27:
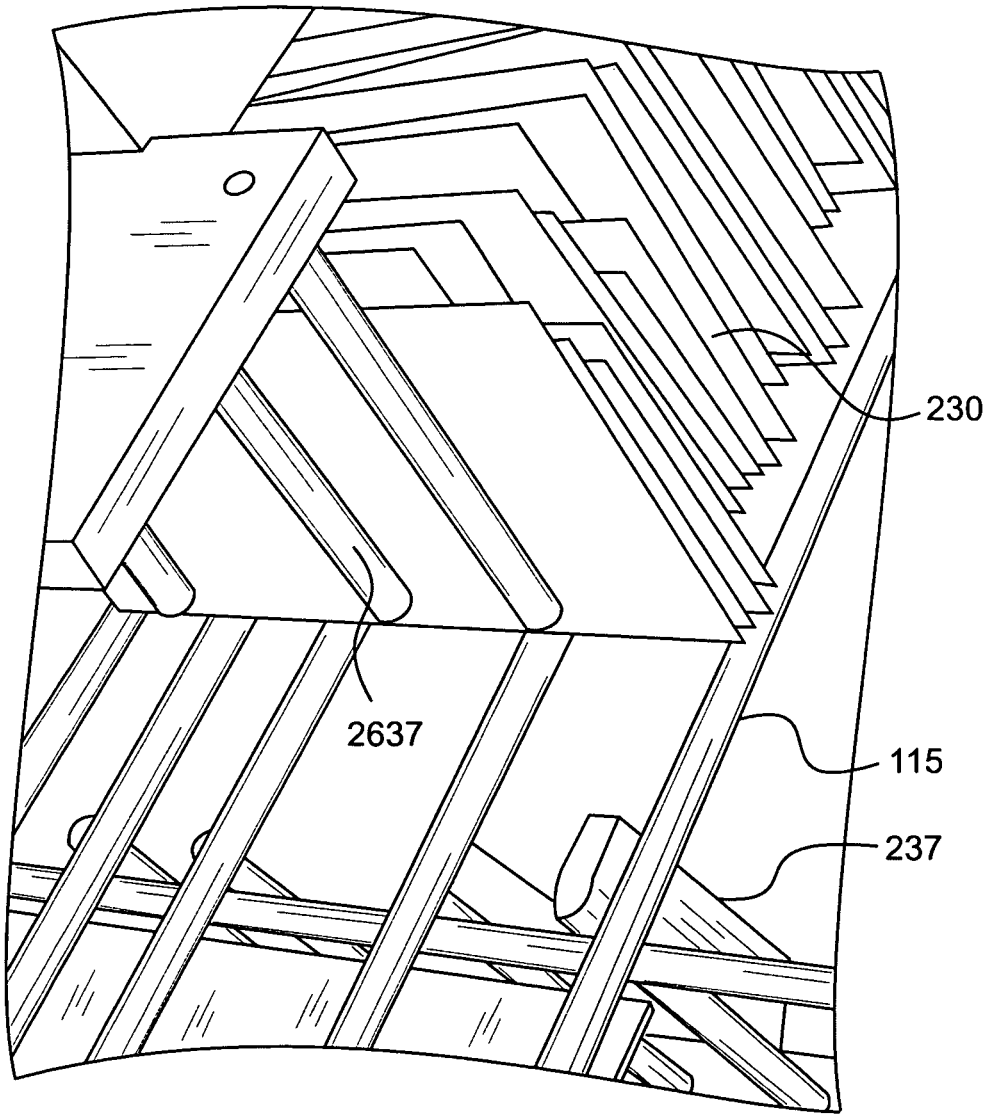
Figure 28:
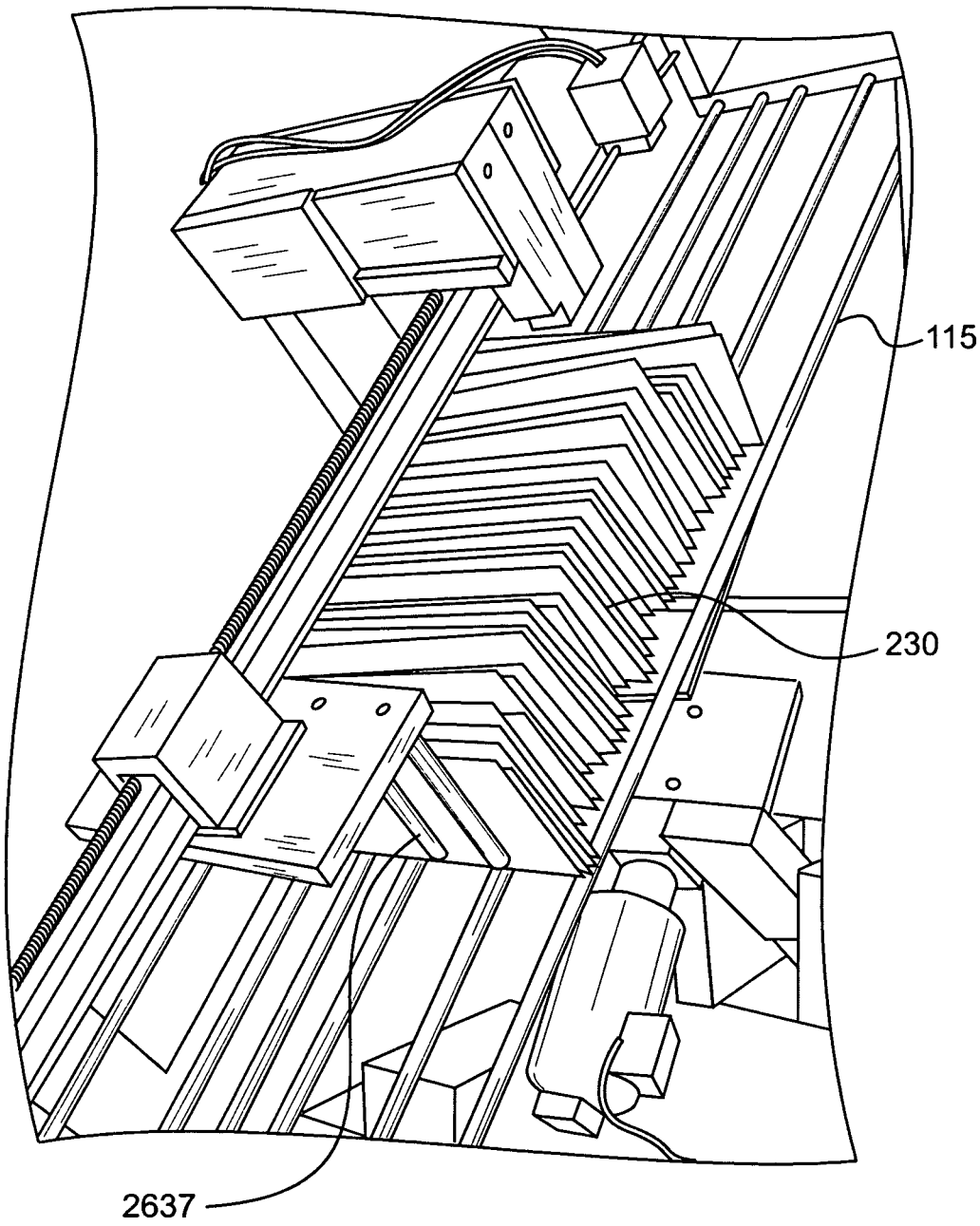
Figure 29:
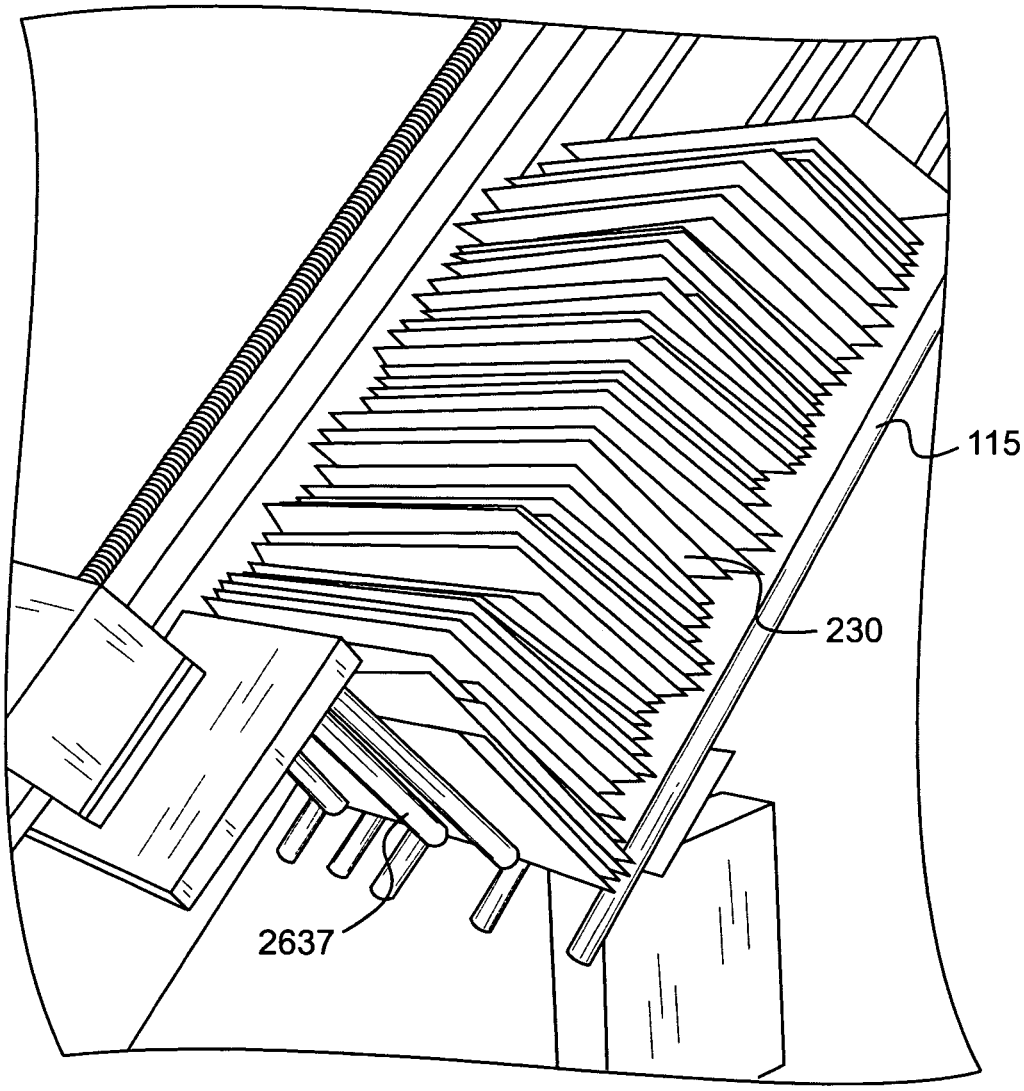
Figure 30:
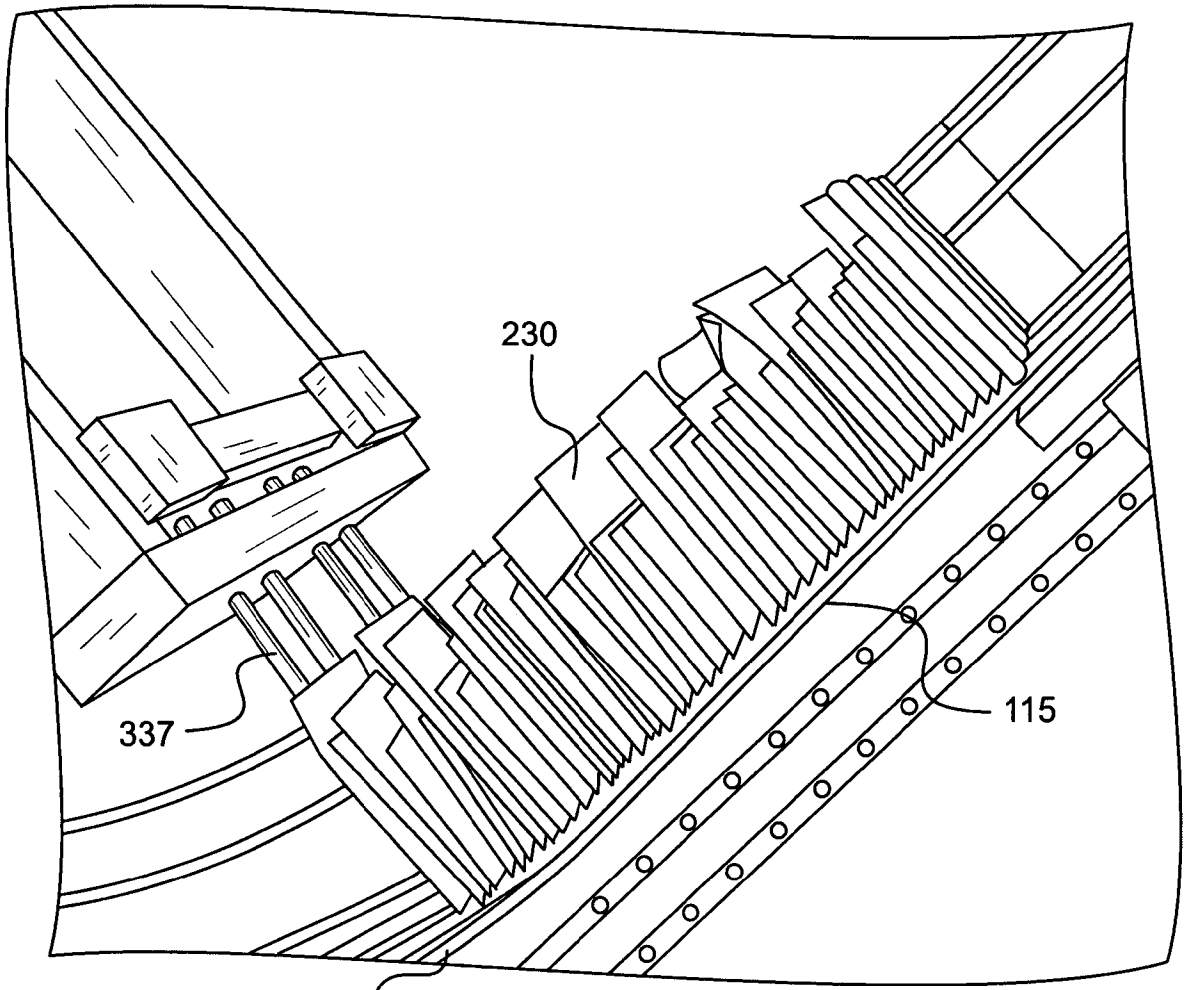

FIGS. 24-29 depict the movement of the mail slug 230 as guided by the combs. In FIGS. 24 and 25, after the mail slug 230 is transferred to decline slide comb 237, lid comb 721 is retracted with lid 122. In FIG. 26, the decline slide comb 237 moves down the decline slide 115 toward second decline slide comb 2637. The angle of decline slide 115 and gravity maintain the integrity of the slug. Decline slide comb 237 passes through a second decline slide comb 2637 transferring mail slug 230. In FIG. 27, decline slide comb 237 is retracted through the bottom of decline slide 115. In FIGS. 27-29, the mail slug 230 continues down decline slide 115 supported by second decline slide comb 2637.

Transition Slide and Feed Table

Figure 31:
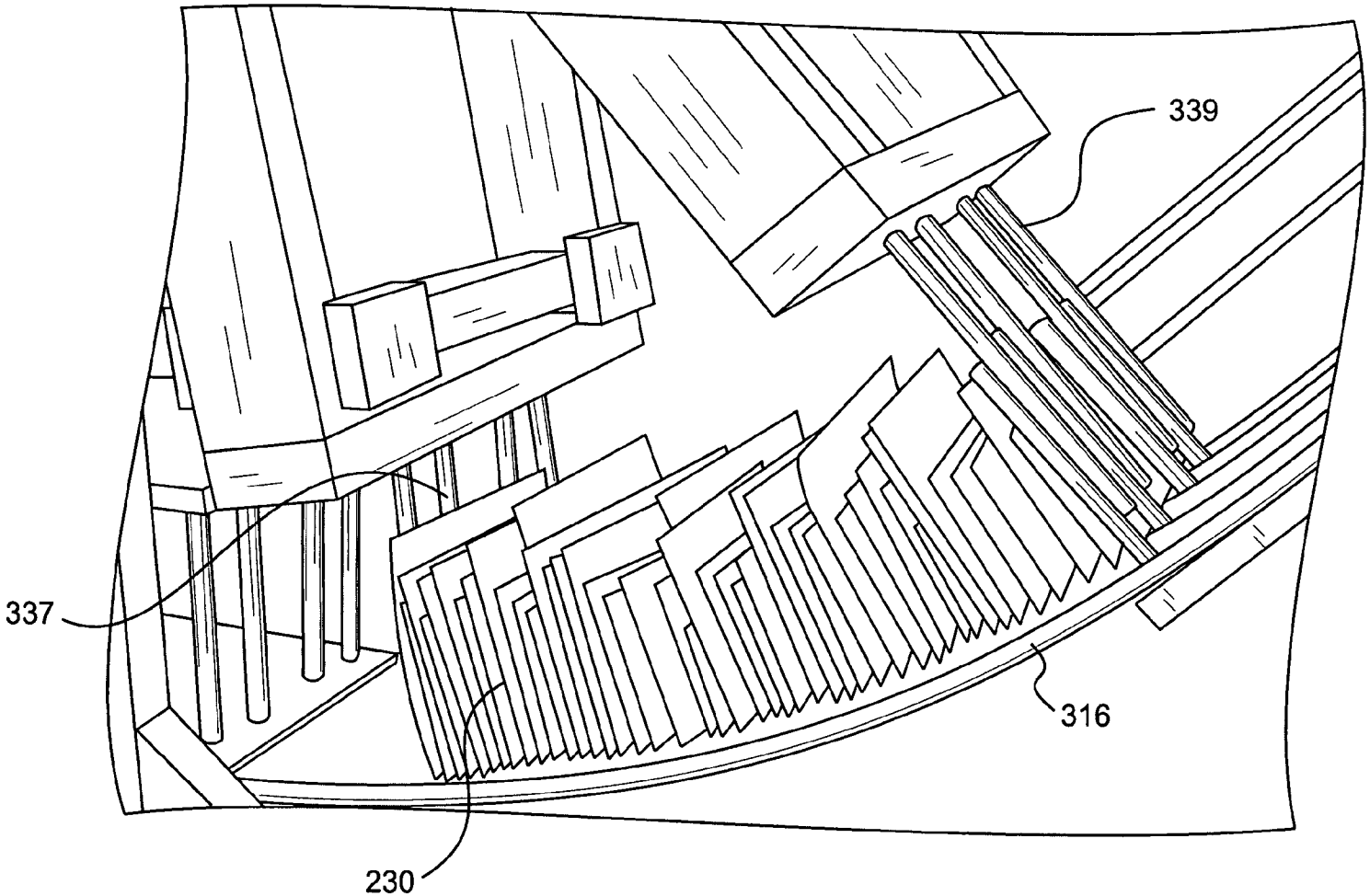
FIGS. 31-35 are diagrams depicting the operation of the transition slide and feed table.
Figure 32:
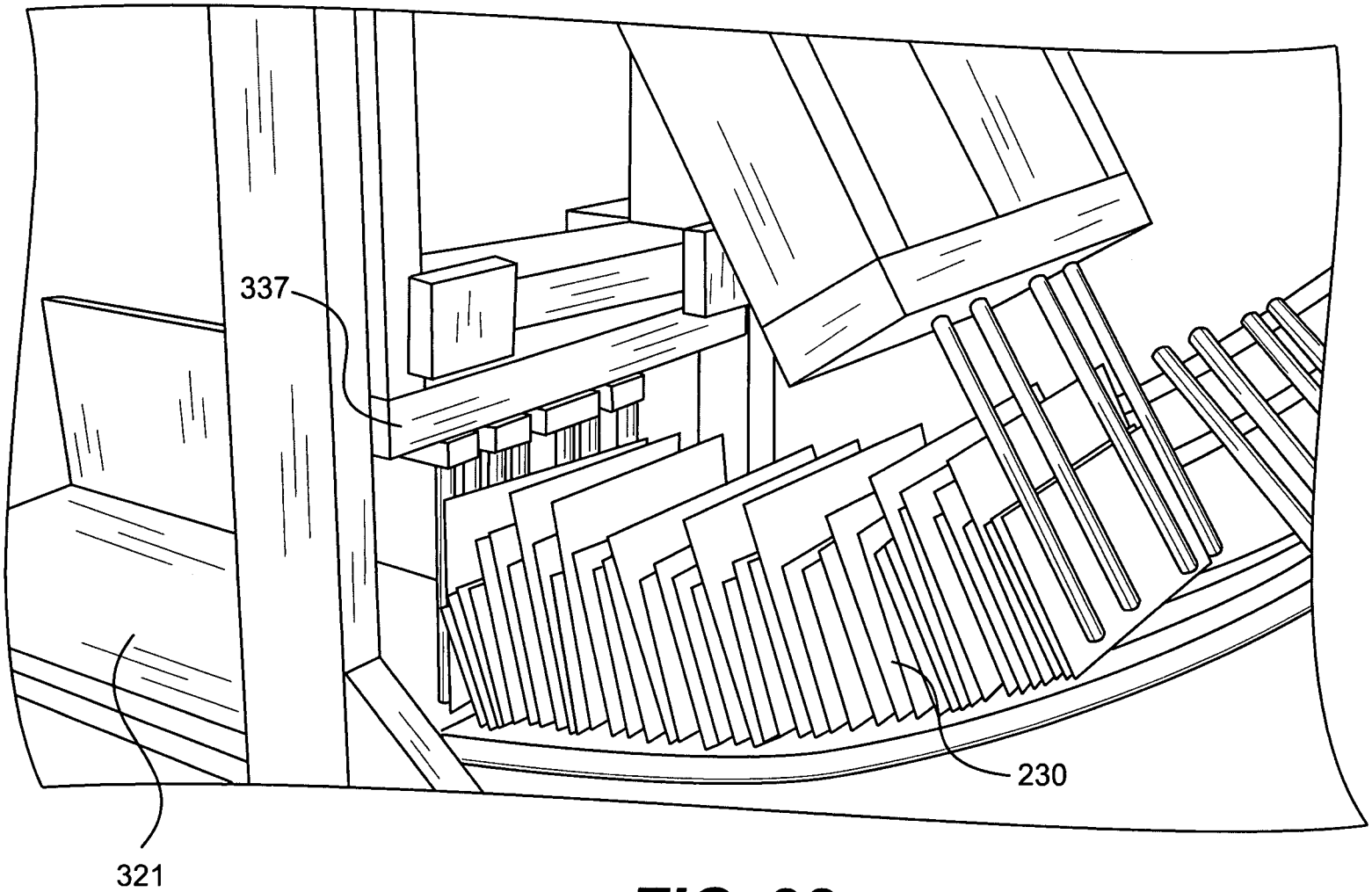
Figure 33:
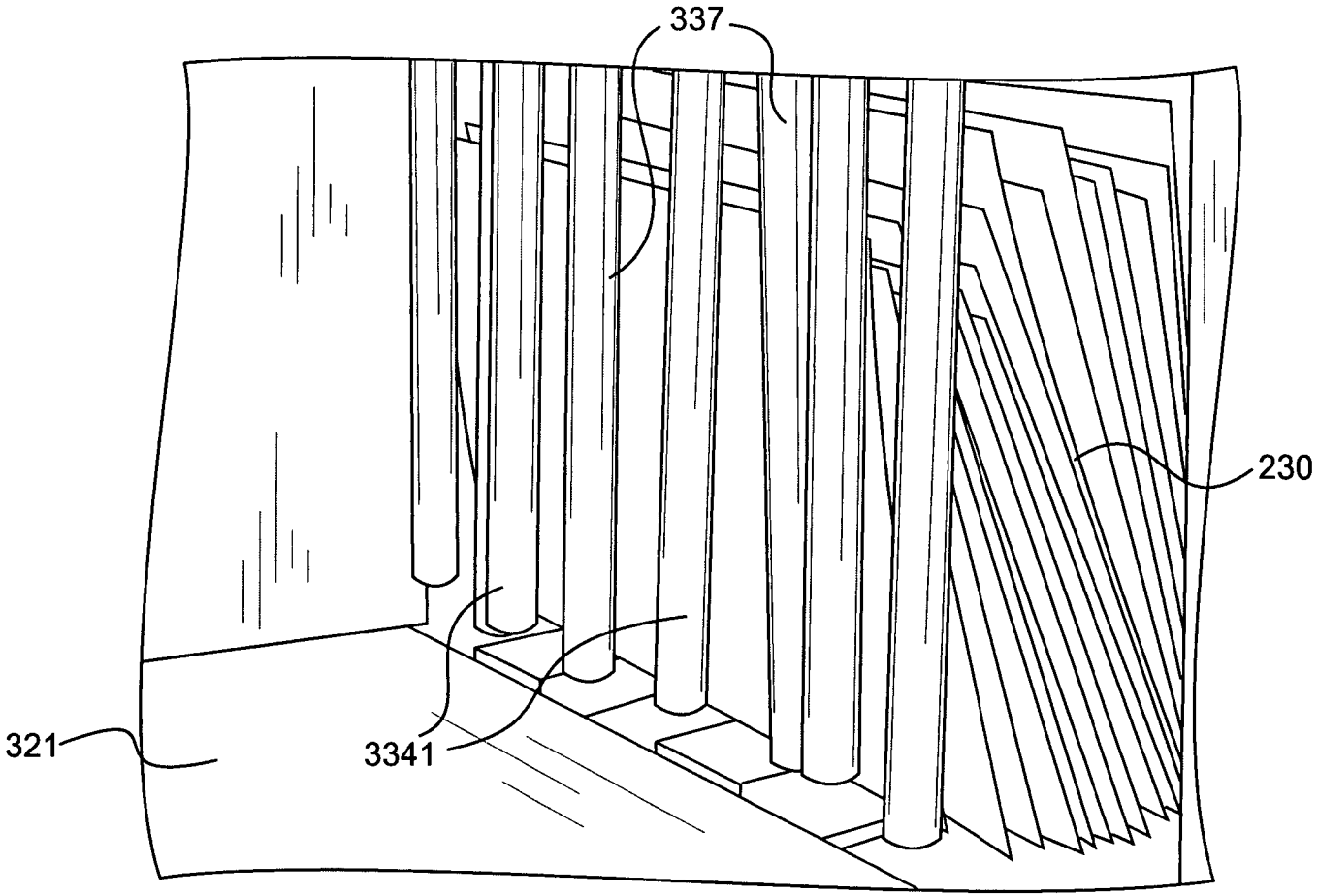

FIGS. 30-36 depict the operation of transition slide 316 and feed table. As depicted in FIGS. 31-36, the mail slug 230 is transferred to leading transition slide comb 337 (also depicted in FIG. 3). Second decline slide comb returns 2637 and moves into position behind mail slug 230. As can be seen in FIG. 32, leading transition slide comb 337 and a trailing decline slide comb 339 move in unison to control mail slug 230. In FIG. 31, trailing transition slide comb 339 replaces second decline slide comb 2637 for the transfer through the curve defined by transition slide 316. Both transition slide combs 337, 339 move in unison to transfer and control mail slug 230. As can be seen in FIG. 33, the leading transition slide comb 337 moves past feed table comb 3341, transferring control of mail slug 230.

Figure 34:
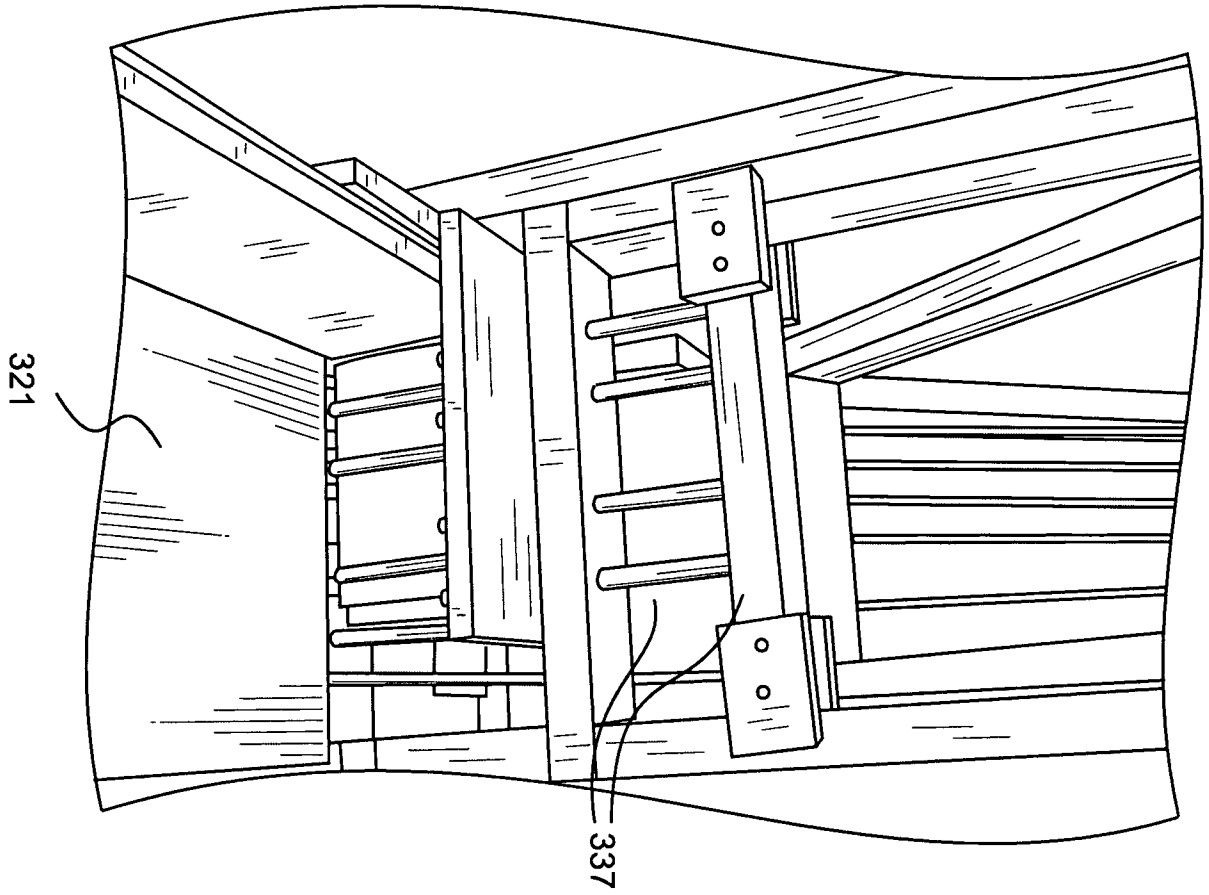
Figure 35:
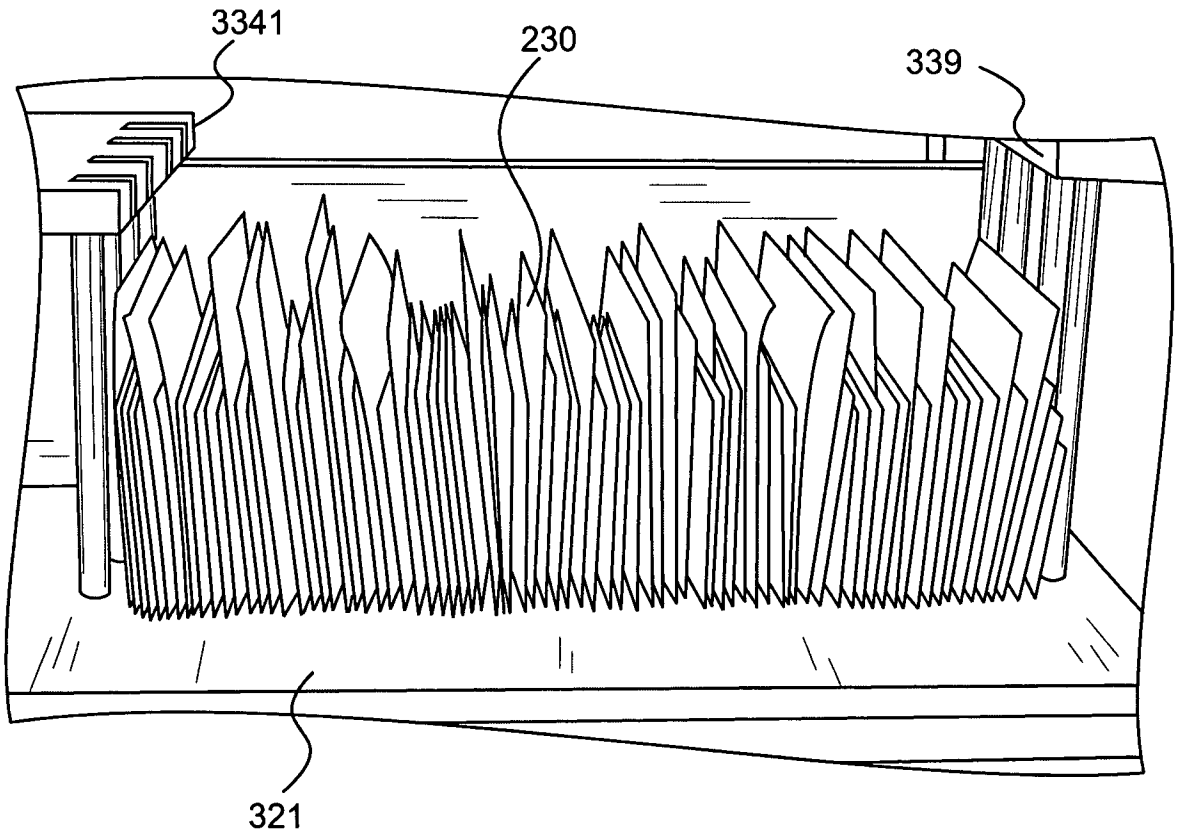

In FIG. 34, the lead transition slide comb 337 retracts. As depicted in FIG. 35, the feed table comb 3341 and trailing transition slide comb 339 move in unison to control the mail slug 230 and effect the transfer to feed table 321.

Inverting and Edge Alignment

Properly edged mail is critical to the performance of the feeder/singulator. It is expected that at times the mail will not be properly edged in the tray. As a result the mail exiting flip unloader 111 will be improperly edged. Automatic mail edging is used to edge the mailpieces. The edging is performed while in the flip unloader box 121, immediately after discharge from the flip unloader box 121 or as the mail is being transferred through the slides. This may be performed by a number of techniques, including gravity, motion and vibration.

The act of inverting the mail in flip unloader 111 back to the upright position after removal of the tray 131 (FIGS. 18-20) has a small but measurable impact on the edge alignment of the mail. It is possible to minimize the edge misalignment during unloading by tuning the apparatus 101, but it was determined that there will need to be some edge alignment improvement mechanisms incorporated into the system. In one example, edge alignment is established in flip unloader 111 portion of the machine. The result is that the mail is edged along two adjacent edges. Once the mail slug 230 is properly edged and aligned, the slug can be transferred along decline slide 115 without degradation.

Occasional mail piece errors may occur in flip unloader 111 and there are designs that will make many of these errors self correcting. For example, mail that is placed sideways in the tray will fall between the tubes of decline slide 115 and be collected and contained in a trough. No operator invention would be required for this error.

Mail slug transfers on decline slide 115 work smoothly. The multi-rail design of the decline slide structure has inherent advantages and allows for the slug control combs to pass through the structure and move as required. In one example, the slug support combs will be at a slight angle to aid in controlling the slug as it moves along decline slide 115.

Figure 36:
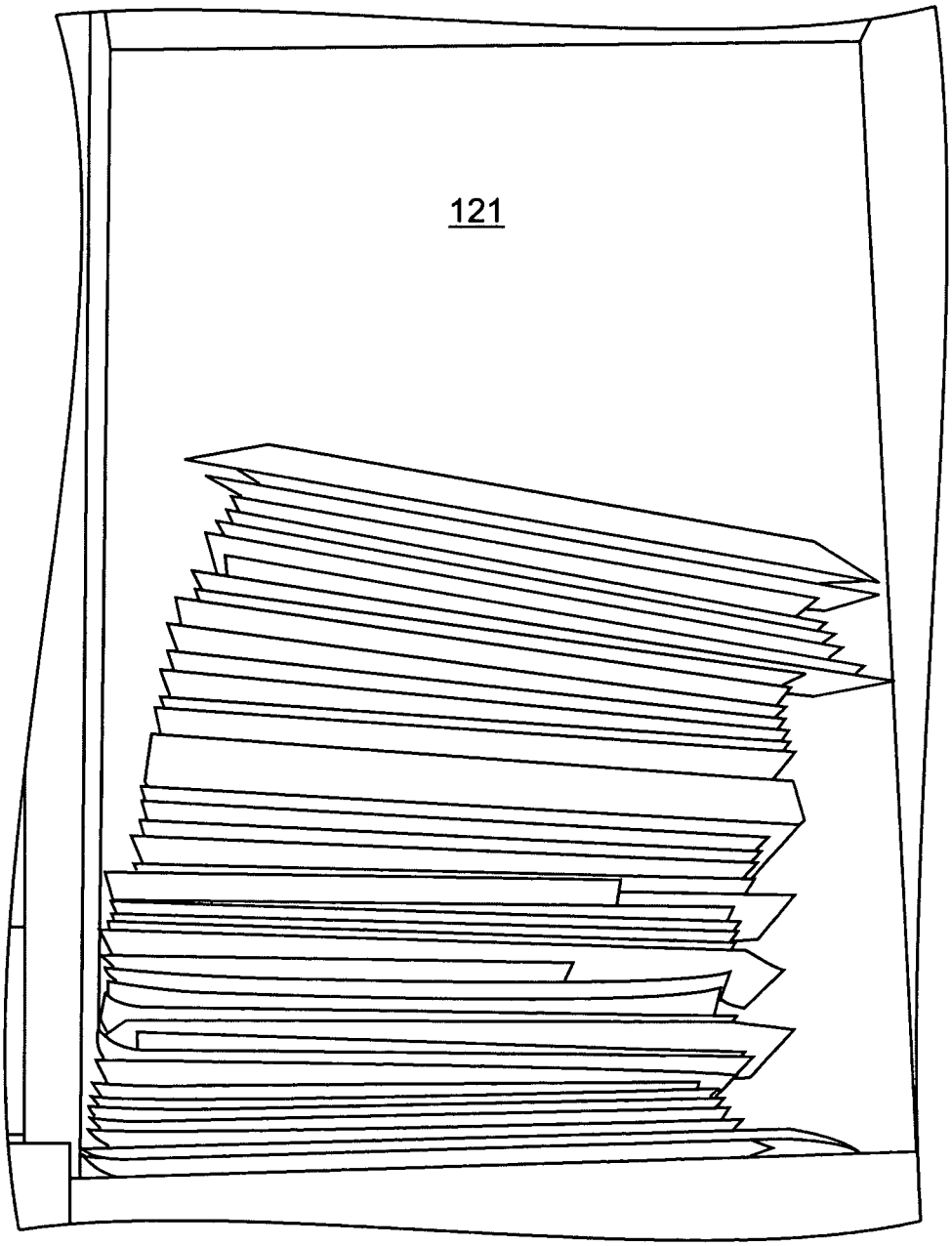
FIGS. 36 and 37 are diagrams depicting edging of mail within the flip unloader.
Figure 37:
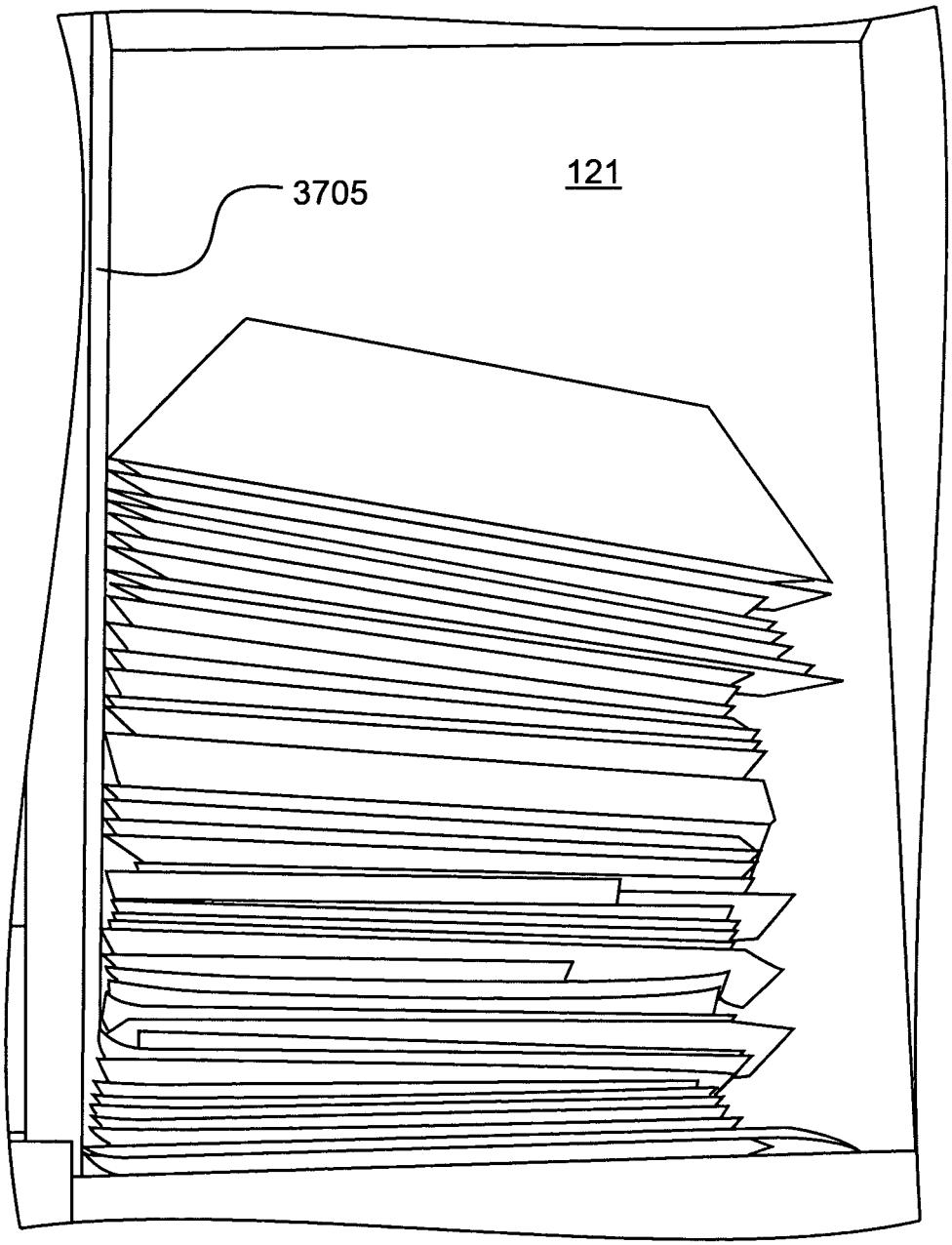
Figure 38:
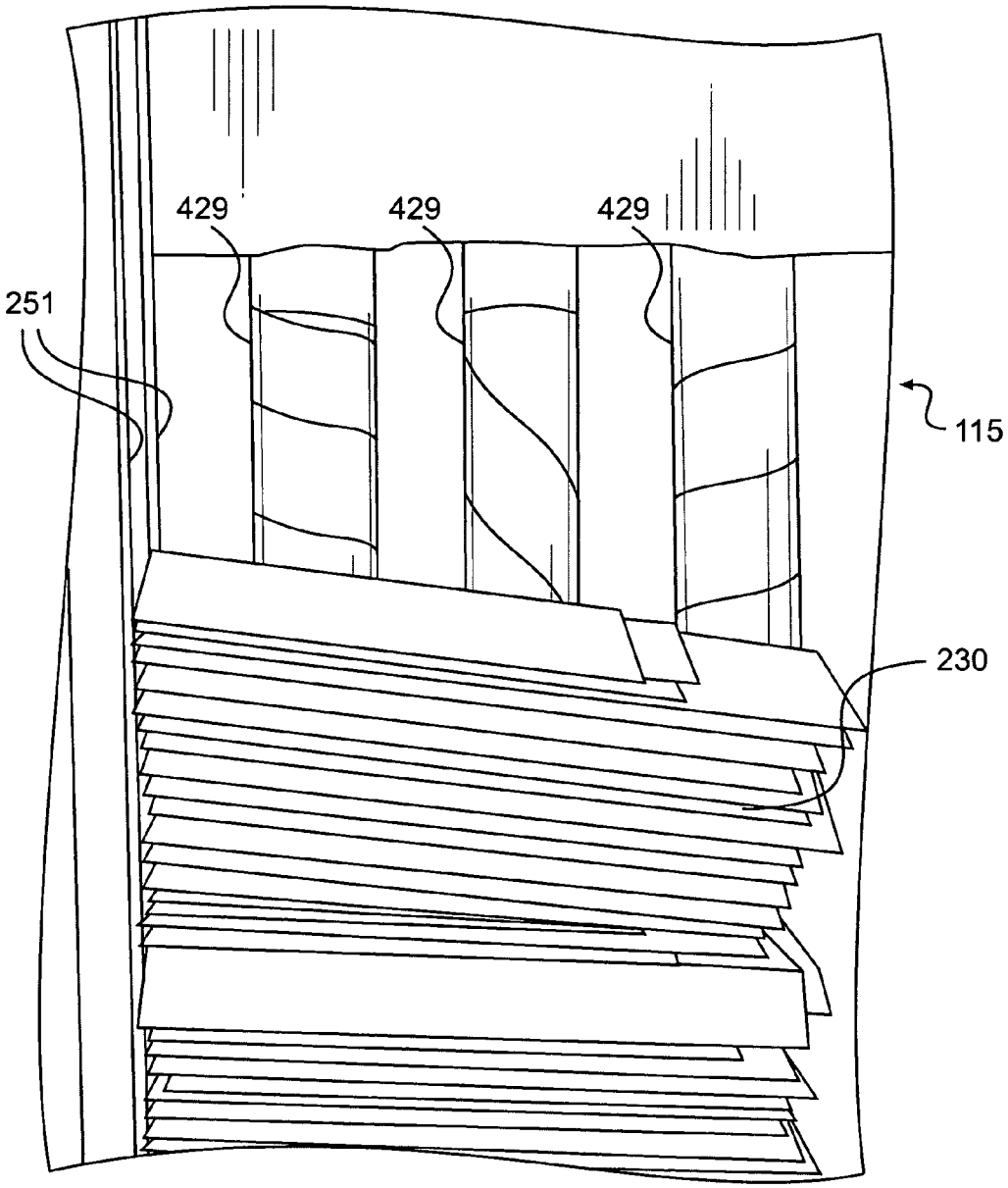
FIG. 38 is a diagram depicting edging of mail moving down the decline slide from the unloader box.
Figure 39:
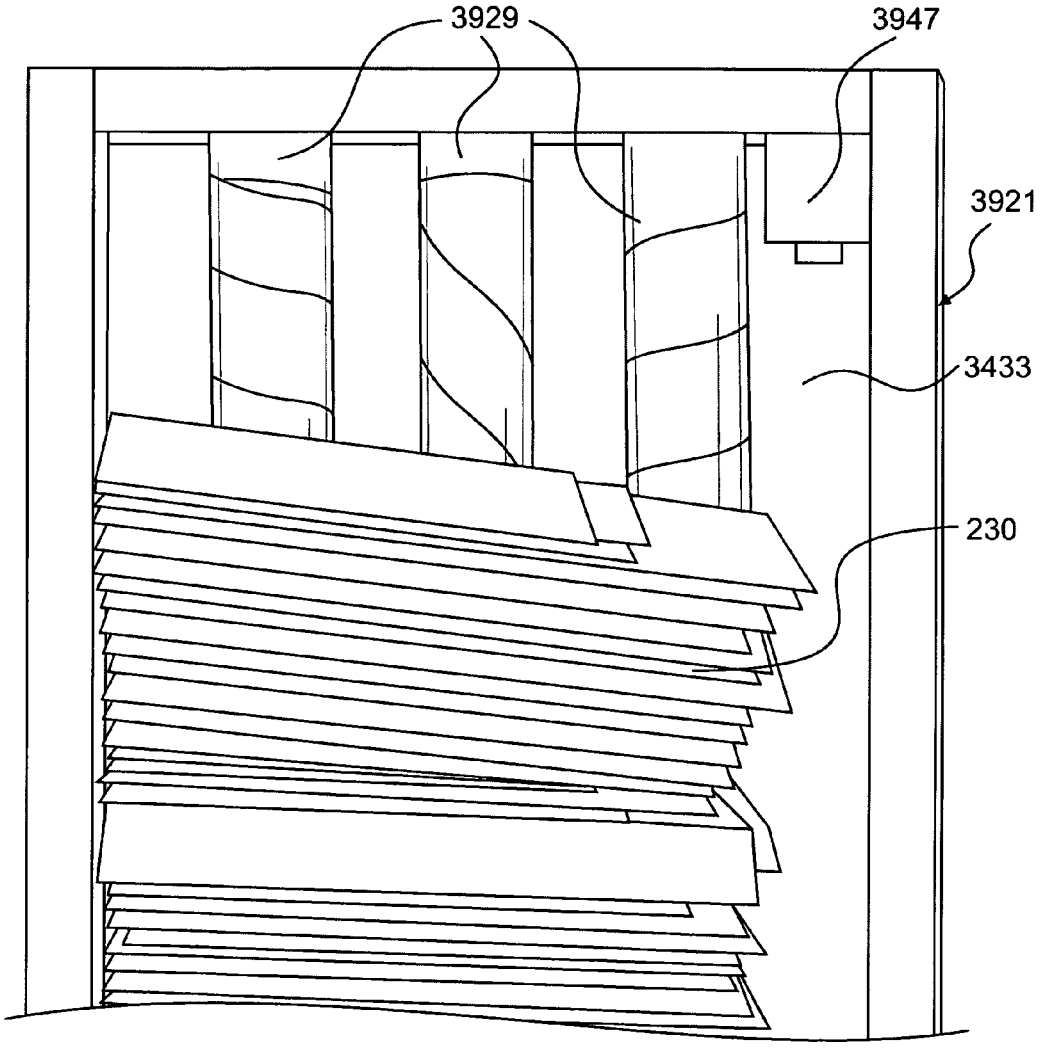
FIG. 39 is a diagram depicting the use of rolling tubes in the flip unloader edging of mail within the flip unloader.

FIGS. 36-39 depict the mail edger operation within the flip unloader 111 and on decline slide 115. In FIG. 36, mail moves down the flip unloader box 121. In FIG. 37, the mail shifts as a result of gravity edge against vertical side 3705 of flip unloader box 121. FIG. 39 shows a modified flip unloader box 3921 in which edging is performed.

FIG. 38 is a diagram depicting edging of mail moving down decline slide 115 or in flip unloader 121. As the mail slug 230 moves on decline slide 115, edging rollers 429 rotate to urge the mail against decline slide support rails 251 on decline slide 115, as described above in connection with FIG. 4. Edging rollers 429 are positioned at a slightly shallower angle than tubes 227, with the upslope ends of edging rollers 429 slightly below the level of tubes 227. This allow the mail to smoothly transition onto edging rollers 429. It is also possible to provide a taper at the lead ends of tubes 227, which would allow the mail to pass the lead edges of tubes 227 without catching on the lead edges.

FIG. 39 is a diagram depicting the use of rolling tubes in the flip unloader box 3921, used for edging of mail within the flip unloader. A plurality of rollers 3929 are located in the bottom flip unloader box 3929. When the mail 230 rests against rollers 3929, the rollers urge the mail to one side of box 3929. Rollers 3929 are rotationally driven by motor 3947, either continuously or during a part of the rotational operation of flip unloader when the mail 230 rests against rollers 3929.

Box 3921 may be open between rollers 3929, leaving open space as depicted at 3951. The open space 3951 facilitates discharge of mail not in the slug, and the stray mailpieces may then be retrieved from the floor or a catch tray (not shown) and placed back in the mail sorting line.

The edging may therefore be performed in flip unloader box 121 against side 3705 or along decline slide 115, or elsewhere. Alternatively, the edging may take place at multiple locations.

As mail slug 230 is transferred along decline slide 115 it has been found that the integrity of the slug is best maintained if the tines of the support combs are at a slight angle. This angle helps maintain the mail slug 230 against the decline slide support rails 251 on decline slide 115. As mail slug 230 is transferred from decline slide 115 to the horizontal feed table 321, the tines of the combs (e.g., combs 339, 3341, shown in FIG. 35) work best when perpendicular.

Basic Configuration

The basic configuration of flip unloader 111 may include flip unloader 111 with edging;

decline slide 115 to transition slide 316;

transition slide 316 to feed table transfer; and feed table transfer from transition slide 316 to the feeder/singulator.

Modalities

In the process of developing any new technology, there is a fair amount of trial and error that leads to further development and retrial. Each step in the maturation of the concept provides a learning experience on what works and what does not work. Overall, there are always some major revelations, or lessons learned, that form the foundation of the design process; those are presented here.

In order to automate the unloading and feeding of letter mail in the trays, some standards are enforced to govern the preparation of mail in the tray. As in any process automation, some boundaries need to be defined in regard to the input. Typically product orientation and size are controlled at the input to an automated industrial process. In the case of flip unloader 111, it is often specified that the letter mail in the tray be of proper orientation (correct facing and standing on edge) and of the proper size (quantity of mail in the tray); this in order to maximize the unloading efficiency.

Space Requirements

In order to minimize the floor space occupied by mail transfer apparatus 101, as much of the hardware as possible may be ceiling supported. Floor supports may be tucked against the feeder/singulator machine wherever possible or outriggers are erected without inhibiting machine access.

Figure 40:
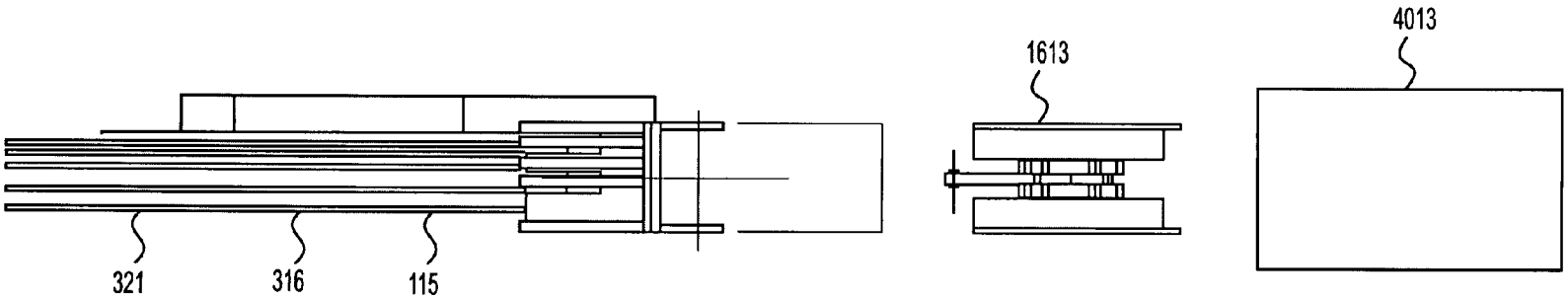
FIGS. 40 and 41 are diagrams showing the relationships of the components in plan and side (elevation) views.
Figure 41:
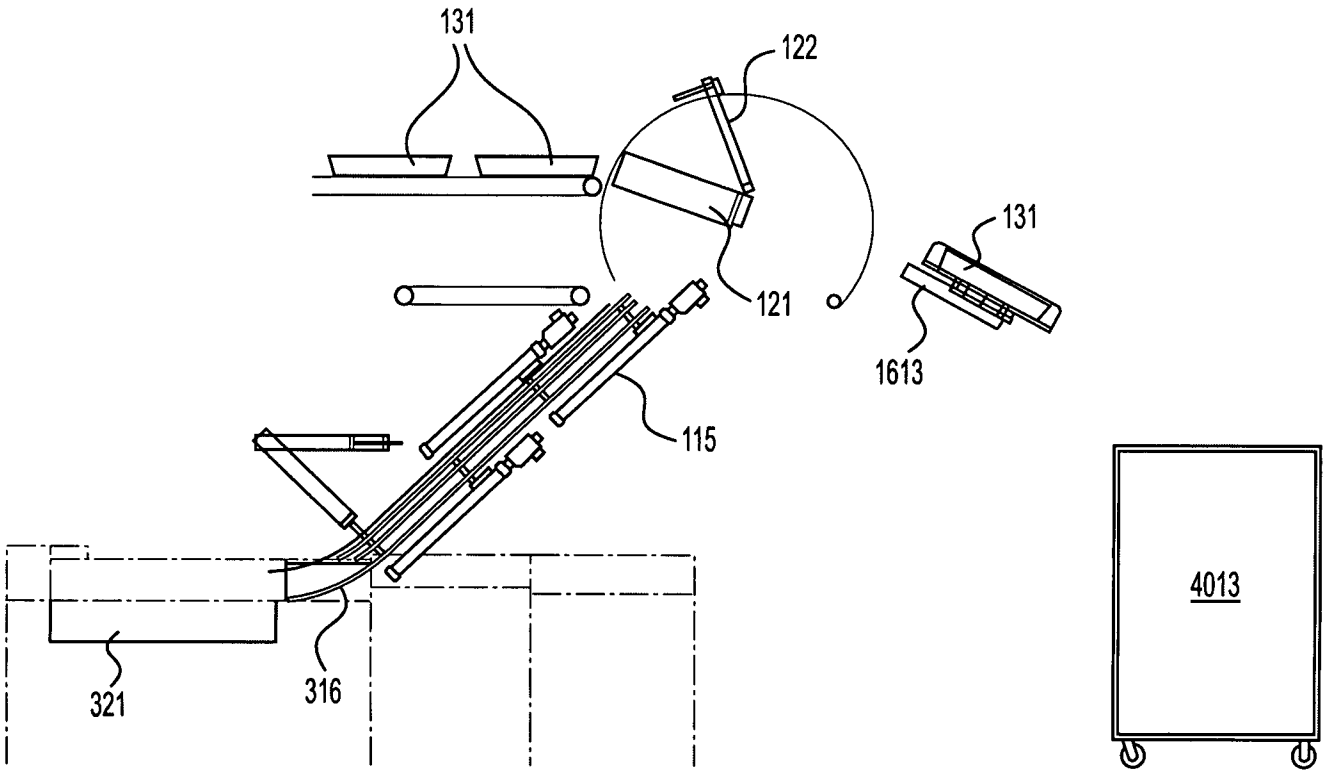

FIGS. 40 and 41 are schematic diagrams showing the relationships of the components in plan and side (elevation) views. In this example configuration, the apparatus 101 is located to receive trays from above the feeder/singulator, with the tray flip unloader 111 located substantially above the floorspace, and decline slide 115 and transition slide 316 feeding down to the feeder/singulator.

Also shown is a tray discharge cart 4013 that receives empty trays from tray discharge chute 1613. In the case of slant edged trays (trays 131), the trays, upon dropping into discharge cart 4013 will possibly nest (not shown). If the trays are straight edged, then the trays can be stacked in discharge cart 4013 without nesting.

Design Factors

Mail manipulation on the feeder/singulator feed table requires overtaking a moving target (the mail already on the feed table moving toward the singulator) with the mail being introduced from the mail transfer apparatus 101. Presently, the operator performs this function using two hands and the feeder/singulator feed paddle. The design of the present apparatus duplicates the operator's manipulations with automated comb/paddle replacements. The feed rate is feeder/singulator paced so the automated function is quick, smooth and precise.

As was discussed in a previous section, mail that has been unloaded from a tray will almost always require edge alignment. It is expected that this function will be performed in the flip unloader box 121. Automatic edge alignment is integrated into the design of the mail transfer apparatus 101. An operator presently utilizes a vibratory device and his hands to jog and align the mail piece edges. In automatic operation, the end over motion coupled with rotational urging will align the mail against the side wall and bottom of the flip unloader box 121 or on the decline slide 115.

In addition to the mail processing requirements for the mail transfer apparatus 101, there are additional motions associated with jam clearing and tray rejects. The design allows for the feeder/singulator to be operated via manual feed with an operator. This requirement demands that the flip unloader device be moved out of the way for operator access to the sorter.

In order for the feeder/singulator to be used for sequencing or other manual sorting, there is the need for the mail transfer apparatus 101 to be stowed or retracted or otherwise moved out of the way for an operator to manual feeding. The motions of the flip unloader box 121 and lid 122 have independent functions that are capable of working in unison. These motions include flip unloader box 121 rotation in both directions with at least six different stop positions and lid open to three different positions and close. The flip unloader 111 may include a full tray or half tray or may be empty so the movements may be smooth with a variable load. In addition, the mass of a lid actuator for lid 122 will be part of the load reflected to the flip unloader's prime mover.

Conclusion

It will be understood that many additional changes in the details, materials, steps and arrangement of parts, which have been herein described and illustrated to explain the nature of the subject matter, may be made by those skilled in the art within the principle and scope of the invention as expressed in the appended claims.

What is claimed is:

1. A method of transferring a plurality of substantially flat items, while maintaining an orientation alignment of the substantially flat items, the method comprising:

receiving the substantially flat items in an open container;

transferring the substantially flat items from the open container to an unloader box by placing the open container into the unloader box, rotating the unloader box to an at least partially inverted position and removing the open container from the unloader box with the unloader box in the inverted position;

returning the unloader box to a non-inverted alignment, while retaining the substantially flat items in the unloader box;

guiding the substantially flat items from the unloader box to a next work station using, as the open container, a tray having a bottom and sidewalls fixed to the bottom and an open top, and providing the plurality of items in the tray with the plurality of the items having an initial alignment;

providing the unloader box with a top portion capable of opening with respect to a remaining portion of the unloader box;

transferring the substantially flat items into the unloader box by receiving the tray holding the items in the unloader box with the top portion opened and with the plurality of items exposed within the unloader box at the open top portion of the unloader box;

positioning the tray within the unloader box with the unloader box closed to cover the open top of the tray;

rotating the unloader box, thereby positioning the open top of the tray in a generally downward facing orientation;

opening the unloader box to expose the tray, with the open top of the tray facing in the generally downward facing orientation;

removing the tray from the unloader box while retaining the plurality of items within the unloader box for subsequent discharge;

providing at least one rest surface, whereby, subsequent to removing the tray from the unloader box, the plurality of flat items rest against the resting surface along one edge of each of the substantially flat items or of most of the substantially flat items;

positioning a first comb comprising a plurality of fingers extending along a direction substantially parallel to a face alignment of the substantially flat items to position the substantially flat items on one side of the first comb, thereby confining the substantially flat items;

moving the first comb, thereby moving the plurality of flat items along the resting surface, with the edges remaining against the resting surface;

transferring the plurality of flat items to a second comb by passing the first comb by the second comb, thereby causing the second comb to engage the substantially flat items;

causing the first comb to retract, thereby disengaging the plurality of flat items from the path of motion; and moving the second comb to move the plurality of flat items along the resting surface.

2. The method of claim 1, further comprising using a vacuum head to remove the tray from the unloader box.

3. The method of claim 1, further comprising, causing the plurality of items to exit the unloader box while maintaining the original alignment; and acting upon the plurality of items to achieve a desired edge alignment of the plurality of items.

4. A method of transferring a plurality of substantially flat items, while maintaining an orientation alignment of the substantially flat items, the method comprising:

receiving the substantially flat items in an open container;

transferring the substantially flat items from the open container to an unloader box by placing the open container into the unloader box, rotating the unloader box to an at least partially inverted position and removing the open container from the unloader box with the unloader box in the inverted position;

returning the unloader box to a non-inverted alignment, while retaining the substantially flat items in the unloader box;

guiding the substantially flat items from the unloader box to a next work station;

after removing the open container from the unloader box, closing the unloader box, thereby containing the plurality of items within the unloader box;

rotating the unloader box to position the plurality of items in a non inverted position, but without the open container;

acting upon the plurality of items within the unloader box to achieve a desired edge alignment along two adjacent edges of the plurality of items; and causing the plurality of substantially flat items to exit the unloader box while maintaining the original orientation alignment of the substantially flat items.

5. The method of claim 4, further comprising, providing a set of rollers extending in a lengthwise direction of the box perpendicular to an orientation of the plurality of items, on at least one of a top and bottom of the unloader box against which the plurality of items rest, thereby allowing the plurality of items to rest edgewise against the rollers; and causing the rollers to rotate, thereby urging the plurality of items toward one side of the unloader box in an edge alignment against said one side of the unloader box.

6. The method of claim 4, further comprising, providing on a bottom portion of the unloader box a set of rollers with the rollers extending in a lengthwise direction of the box perpendicular to an orientation of the plurality of items;

after removing the open container from the unloader box and returning the unloader box to a non-inverted alignment, allowing the plurality of items to rest edgewise against the rollers; and causing the rollers to rotate, thereby urging the plurality of items toward one side of the unloader box in an edge alignment against said one side of the unloader box.

7. The method of claim 4, further comprising, receiving the substantially flat items in an open container in the non-inverted position at a first angle; and rotating the unloader box to position the plurality of items in the non inverted position at a second angle, and causing the plurality of substantially flat items to exit the unloader box with the unloader box at the second angle.

8. The method of claim 4, further comprising, receiving the substantially flat items in an open container in the non-inverted position at a first angle; and rotating the unloader box to position the plurality of items in the non inverted position at a second angle, and causing the plurality of substantially flat items to exit the unloader box with the unloader box at the second angle, wherein the second angle aligns the unloader box for guiding the substantially flat items from the unloader box to the next work station.

9. The method of claim 4, further comprising, after discharging the substantially flat items from the unloader box, further acting upon the plurality of items to achieve or maintain a desired edge alignment of the plurality of items along two adjacent edges.

10. The method of claim 4, further comprising:

while guiding the substantially flat items from the unloader box to a next work station, acting upon the plurality of items within the unloader box to achieve or maintain the desired edge alignment of the plurality of items along the two adjacent edges.

11. A method for transfer contents from a container, the contents comprising a plurality of substantially flat items, the method comprising:

receiving the container as an open container having an initial orientation alignment, and with top edges of the substantially flat items exposed;

covering the top edges of the contents with a cover mechanism;

with the top edges of contents covered, rotating the container and cover mechanism;

removing the container while retaining the contents in an alignment corresponding to a rotation of the original orientation alignment;

rotating the cover mechanism and the contents while retaining the contents;

after removing the container, rotating the contents, thereby transferring the contents from the cover mechanism while maintaining the contents in a uniform alignment and in the initial orientation alignment of the contents;

during the transfer of the contents, acting upon the plurality of items to achieve a desired edge alignment along two adjacent edges of the plurality of items;

causing the items to move along a transfer guideway after removing the container;

providing a set of rollers extending parallel to a direction of transfer along the guideway and perpendicular to an orientation of the plurality of items;

allowing the plurality of items to rest edgewise against the rollers along the guideway during the transfer; and causing the rollers to rotate, thereby urging the plurality of items toward one side of the guideway in an edge alignment against said one side of the guideway.

12. The method of claim 11, further comprising:

after removing the container, rotating the contents, thereby transferring the contents in the initial orientation alignment of the contents.

13. A method for transfer contents from a container, the contents comprising a plurality of substantially flat items, the method comprising:

receiving the container as an open container having an initial orientation alignment, and with top edges of the substantially flat items exposed;

covering the top edges of the contents with a cover mechanism;

with the top edges of contents covered, rotating the container and cover mechanism;

removing the container while retaining the contents in an alignment corresponding to a rotation of the original orientation alignment; and after removing the container, rotating the cover mechanism and the contents while retaining the contents, thereby transferring the contents in the initial orientation alignment of the contents;

transferring the contents from the cover mechanism while maintaining the contents in a uniform alignment, and during the transfer of the contents, acting upon the plurality of items to achieve a desired edge alignment along two adjacent edges of the plurality of items;

receiving the container in an unloader box by placing the open container into the unloader box, rotating the unloader box to an at least partially inverted position and removing the open container from the unloader box with the unloader box in the inverted position;

returning the unloader box to a non-inverted alignment, while retaining the substantially flat items in the unloader box;

providing a set of rollers extending in a lengthwise direction of the box perpendicular to an orientation of the plurality of items, on at least one of a top and bottom of the unloader box against which the plurality of items rest, thereby allowing the plurality of items to rest edgewise against the rollers;

causing the rollers to rotate, thereby urging the plurality of items toward one side of the unloader box in an edge alignment against said one side of the unloader box;

causing the items to move along a transfer guideway after removing the container;

providing a set of rollers extending parallel to a direction of transfer along the guideway and perpendicular to an orientation of the plurality of items;

allowing the plurality of items to rest edgewise against the rollers along the guideway during the transfer; and causing the rollers to rotate, thereby urging the plurality of items toward one side of the guideway in an edge alignment against said one side of the guideway, the edge alignment corresponding to the edge alignment against said one side of the unloader box.

14. A method for moving a plurality of substantially flat items having substantially varied dimensions within predetermined limits, the method comprising:

providing at least one rest surface, whereby the plurality of flat items rest against the resting surface along one edge of each of the substantially flat items or of most of the substantially flat items;

positioning a first comb comprising a plurality of fingers extending along a direction substantially parallel to a face alignment of the substantially flat items to position the substantially flat items on one side of the first comb, thereby confining the substantially flat items;

moving the first comb to move the plurality of flat items along the resting surface, with the edges remaining against the resting surface;

transferring the plurality of flat items to a second comb by passing the first comb by the second comb, thereby causing the second comb to engage the substantially flat items;

causing the first comb to disengage the plurality of flat items; and moving the second comb to move the plurality of flat items along the resting surface.

15. The method of claim 14, further comprising:

during the moving of the plurality of substantially flat items, acting upon the plurality of items to achieve a desired edge alignment along two adjacent edges of the plurality of items.

16. The method of claim 14, further comprising, providing a set of rollers extending parallel to a direction of movement of the substantially flat items and perpendicular to an orientation of the plurality of items;

allowing the plurality of items to rest edgewise against the rollers during the moving of the plurality of substantially flat items; and causing the rollers to rotate, thereby urging the plurality of items into a predetermined edge alignment.

17. A method for transfer of a plurality of items to a transport guideway, while maintaining an alignment of the plurality of items, the method comprising:

providing the plurality of items in a tray, with the plurality of the items having an initial alignment;

receiving the tray holding the items with an open top in an unloader box with the plurality of items exposed within the unloader box at the open top;

controlling the receipt of the tray holding the items in a manner whereby the plurality of items shift forward in the tray to create a gap between the items and one end of the tray;

positioning the tray within the unloader box with the unloader box closed, thereby covering the open top of the tray and allow insertion of a comb formed paddle between the plurality of items and the end of the tray;

rotating the unloader box , thereby positioning the open top of the tray in a generally downward facing orientation;

opening the unloader box to expose the tray, with the open top of the tray facing in the generally downward facing orientation; and removing the tray from the unloader box while retaining the plurality of items within the unloader box for subsequent discharge.

18. The method of claim 17, further comprising, providing a set of rollers extending in a lengthwise direction of the box perpendicular to an orientation of the plurality of items, on at least one of a top and bottom of the unloader box against which the plurality of items rest, thereby allowing the plurality of items to rest edgewise against the rollers; and causing the rollers to rotate, thereby urging the plurality of items toward one side of the unloader box in an edge alignment against said one side of the unloader box.

19. The method of claim 17, further comprising, after removing the tray from the unloader box, closing the unloader box, thereby containing the plurality of items within the unloader box;

rotating the unloader box, thereby positioning the plurality of items in an upright alignment corresponding to the initial alignment, but without the tray;

acting upon the plurality of items within the unloader box to achieve a desired edge alignment of the plurality of items; and causing the plurality of items to exit the unloader box while maintaining the original alignment.

20. The method of claim 17, comprising receiving, as the plurality of items, a batch of postal mail, having an alignment established by a face side and position of an address or an address barcode.

21. The method of claim 17, further comprising using a vacuum head to remove the tray from the unloader box.

* * * * *